US011906253B2

(12) United States Patent
Dong et al.

(10) Patent No.: US 11,906,253 B2
(45) Date of Patent: Feb. 20, 2024

(54) HEAT EXCHANGE DEVICE

(71) Applicant: SANHUA (HANGZHOU) MICRO CHANNEL HEAT EXCHANGER CO., LTD., Zhejiang (CN)

(72) Inventors: Zhiming Dong, Zhejiang (CN); Peng Qin, Zhejiang (CN); Qiang Gao, Zhejiang (CN); Xionglin Li, Zhejiang (CN); Michael Shows, Zhejiang (CN); James Thomas, Zhejiang (CN)

(73) Assignee: SANHUA (HANGZHOU) MICRO CHANNEL HEAT EXCHANGER CO., LTD., Zhejiang (CN)

( * ) Notice: Subject to any disclaimer, the term of this patent is extended or adjusted under 35 U.S.C. 154(b) by 113 days.

(21) Appl. No.: 17/630,372

(22) PCT Filed: Jul. 26, 2019

(86) PCT No.: PCT/CN2019/098034
§ 371 (c)(1),
(2) Date: Jan. 26, 2022

(87) PCT Pub. No.: WO2021/016769
PCT Pub. Date: Feb. 4, 2021

(65) Prior Publication Data

US 2022/0282939 A1 Sep. 8, 2022

(51) Int. Cl.
*F28D 1/047* (2006.01)
*F24F 13/22* (2006.01)
(Continued)

(52) U.S. Cl.
CPC ..... *F28F 17/005* (2013.01); *F28F 9/0221* (2013.01)

(58) Field of Classification Search
CPC .... F24F 13/22; F24F 13/222; F24F 2013/227; F28D 1/0475; F28D 1/0476; F28F 13/04; F28F 17/005
See application file for complete search history.

(56) References Cited

U.S. PATENT DOCUMENTS 4,000,779 A * 1/1977 Irwin ..... F24F 13/22 165/DIG. 197
5,199,276 A * 4/1993 Sullivan ..... F24F 13/22 220/571
(Continued)

FOREIGN PATENT DOCUMENTS

CN 201731683 U * 2/2011
CN 202902995 U 4/2013
(Continued)

OTHER PUBLICATIONS

International Search Report dated Mar. 27, 2020 for corresponding International Application No. PCT/CN2019/098034, dated Jul. 26, 2019.
(Continued)

*Primary Examiner* — Frantz F Jules
*Assistant Examiner* — Jason N Thompson
(74) *Attorney, Agent, or Firm* — David D. Brush; Westman, Champlin & Koehler, P.A.

(57) ABSTRACT

A heat exchange device includes a heat exchanger and a water guider. The water guider is arranged on the heat exchanger and has a water guide groove, and condensed water on at least a part of the heat exchanger can flow out through the water guide groove. The heat exchange device has a good drainage performance, can prevent the condensed water from accumulating, and thus improves a heat exchange area and a heat exchange efficiency of the heat exchanger.

17 Claims, 19 Drawing Sheets

(51) Int. Cl.

| | |
|---|---|
| ***F28F 17/00*** | (2006.01) |
| ***F28F 13/04*** | (2006.01) |
| ***F28F 9/02*** | (2006.01) |

(56) References Cited

U.S. PATENT DOCUMENTS

| | | | | |
|---|---|---|---|---|
| 2007/0169497 | A1* | 7/2007 | Rios | F28F 17/005 62/286 |
| 2012/0279689 | A1* | 11/2012 | Wang | F28D 1/047 165/144 |
| 2016/0334129 | A1* | 11/2016 | Shinoda | F25B 39/02 |
| 2017/0059188 | A1* | 3/2017 | Hancock | F28F 1/32 |
| 2017/0159967 | A1* | 6/2017 | Kawanori | F24F 1/48 |
| 2019/0234651 | A1* | 8/2019 | Kilgo | F24F 13/222 |
| 2020/0378648 | A1* | 12/2020 | Mercer | F28F 17/005 |

FOREIGN PATENT DOCUMENTS

| | | | | | |
|---|---|---|---|---|---|
| CN | 203464545 | U | | 3/2014 | |
| CN | 107843031 | A | | 3/2018 | |
| CN | 109425237 | A | * | 3/2019 | F28D 1/0358 |
| CN | 109425237 | A | | 3/2019 | |
| JP | 2005241168 | A | | 9/2005 | |

OTHER PUBLICATIONS

Written Opinion of the International Searching Authority dated Mar. 27, 2020 for corresponding International Application No. PCT/CN2019/098034, filed Jul. 26, 2019.

English translation of the Written Opinion of the International Searching Authority dated Apr. 9, 2020 for corresponding International Application No. PCT/CN2019/098034, filed Jul. 26, 2019.

* cited by examiner

HEAT EXCHANGE DEVICE

CROSS REFERENCE TO RELATED APPLICATIONS

The present application is a national phase entry under 35 U.S.C. § 371 of International Application No. PCT/CN2019/098034, filed on Jul. 26, 2019, the entire disclosure of which is incorporated herein by reference, and published as WO 2021/016769 on Feb. 4, 2021, not in English.

TECHNICAL FIELD

The present disclosure relates to a field of heat exchange technologies, and more particularly, to a heat exchange device.

BACKGROUND

In the related art, condensed water tends to accumulate at a certain part of a heat exchanger, which will cause a drainage difficulty and a water blowing phenomenon, thus affecting the reliability and comfort of a product. Moreover, too much condensed water accumulates on the surface of the heat exchanger to form a water film, and an effective heat exchange area and a heat exchange efficiency of the heat exchanger are reduced due to a low heat conductivity coefficient of water.

SUMMARY

An embodiment of the present disclosure provides a heat exchange device. The heat exchange device includes a heat exchanger and a water guider. The heat exchanger includes: a first header and a second header arranged in a direction; a plurality of flat tubes, each flat tube including a first straight section, a second straight section and a bent section, in which one end of the first straight section is connected to the first header, the other end of the first straight section is connected to one end of the bent section, the other end of the bent section is connected to one end of the second straight section, the other end of the second straight section is connected to the second header, a predetermined included angle is formed between a length direction of the first straight section and a length direction of the second straight section, and the first straight portion and the second straight portion define a gap therebetween in the direction in which the first header and the second header are arranged; and fins arranged between the first straight sections of adjacent flat tubes and between the second straight sections of adjacent flat tubes, respectively. The heat exchanger includes a first straight portion, a second straight portion and a bent portion. The first straight portion includes the first straight sections of the plurality of flat tubes and the fins arranged between the first straight sections of adjacent flat tubes, the second straight portion includes the second straight sections of the plurality of flat tubes and the fins arranged between the second straight sections of adjacent flat tubes, the bent portion includes the bent sections of the plurality of flat tubes, and the bent portion encloses a groove portion that opens toward a gap between the first straight portion and the second straight portion. The water guider has a first end arranged between the first straight portion and the second straight portion and in contact with the first straight portion and the second straight portion respectively, and a second end extending to the groove portion. A length direction of the water guider is substantially parallel to a width direction of the heat exchanger. The water guider has a water guide groove, a length direction of the water guide groove is substantially parallel to the length direction of the water guider, and the water guide groove allows condensed water on at least a part of the heat exchanger to flow out therethrough.

DETAILED DESCRIPTION

Figure 1:
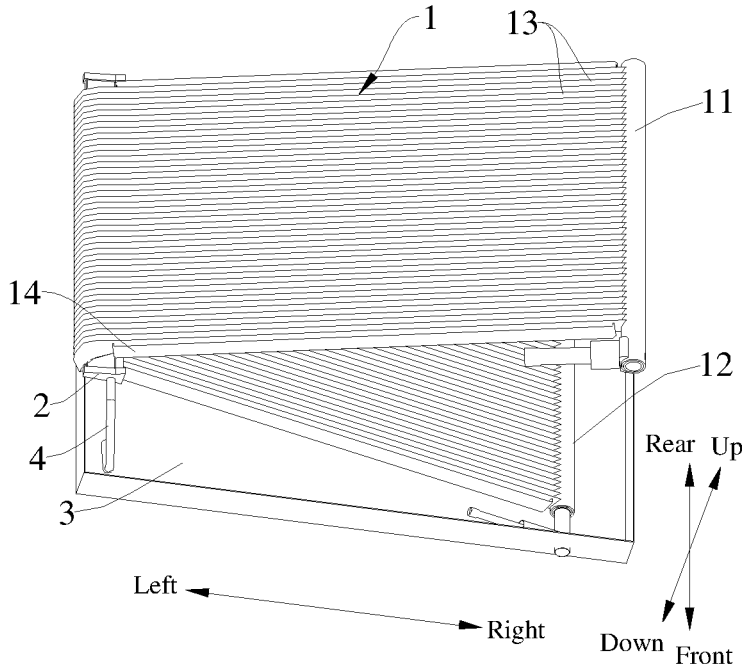
FIG. 1 is a schematic view illustrating an overall structure of a heat exchange device according to an embodiment of the present disclosure.

A description will be made in detail to the embodiments of the present disclosure, examples of which are illustrated in the accompanying drawings. The embodiments described below with reference to the accompanying drawings are exemplary, and are intended to explain the present disclosure, rather than being construed as limitations to the present disclosure. In the description of the present disclosure, it should be understood that the orientation or position relations indicated via terms of "central," "longitudinal," "transverse," "length," "width," "thickness," "upper," "lower," "front," "rear," "left," "right," "vertical," "horizontal," "top," "bottom," "inner," "outer," and the like are based on orientation or the position relations shown in the drawings, so as only to describe the present disclosure conveniently and simplify the description, but not to indicate or imply that referred devices or elements must have particular orientations or be constructed and operated with the particular orientation, so that they cannot be construed as limitations to the present disclosure.

An embodiment of the present disclosure provides a heat exchange device. The heat exchange device includes a heat exchanger and a water guider, the water guider is arranged on the heat exchanger and has a water guide groove, and the water guide groove allows condensed water on at least a part of the heat exchanger to flow out therethrough.

In the heat exchange device according to the embodiment of the present disclosure, since the water guider with the water guide groove is arranged on the heat exchanger, the condensed water on the at least part of the heat exchanger can flow out through the water guide groove, thereby improving a drainage performance, preventing the condensed water from accumulating, and improving an effective heat exchange area and a heat exchange efficiency of the heat exchanger.

In some embodiments, a length direction of the water guider is substantially parallel to a width direction of the heat exchanger, and a length direction of the water guide groove is substantially parallel to the length direction of each water guider.

In some embodiments, the heat exchanger includes a plurality of heat exchange tubes arranged at intervals, and a plurality of the water guiders are provided and arranged at intervals in a length direction of the heat exchange tube.

In some embodiments, the heat exchanger includes: a first headers and a second header arranged at intervals; a plurality of flat tubes, each flat tube including a first straight section, a second straight section and a bent section, wherein one end of the first straight section is connected to the first header, the other end of the first straight section is connected to one end of the bent section, the other end of the bent section is connected to one end of the second straight section, the other end of the second straight section is connected to the second header, the bent section is twisted at a predetermined torsion angle relative to the first straight section and the second straight section around a length direction of the flat tube, the flat tube is bent at the bent section so that a predetermined included angle is formed between the first straight section and the second straight section, and the water guider is arranged between the first straight section and the second straight section; and fins arranged between the first straight sections of adjacent flat tubes and between the second straight sections of adjacent flat tubes, respectively.

In some embodiments, the heat exchanger includes a first straight portion, a second straight portion and a bent portion, wherein the first straight portion includes the first straight sections of the plurality of flat tubes and the fins arranged between the first straight sections of adjacent flat tubes, the second straight portion includes the second straight sections of the plurality of flat tubes and the fins arranged between the second straight sections of adjacent flat tubes, the bent portion includes the bent sections of the plurality of flat tubes, and is provided with a groove portion that opens toward a gap between the first straight portion and the second straight portion, a first end of the water guider in a width direction thereof is arranged between the first straight portion and the second straight portion and is in contact with the first straight portion and the second straight portion respectively, and a second end of the water guider in the width direction thereof extends to the groove portion.

In some embodiments, the water guider includes a body, a first end plate and a second end plate, wherein the water guide groove penetrates through the body along a length direction of the body, the body has a first end and a second end in the length direction thereof, the first end plate is arranged at the first end of the body, the second end plate is arranged at the second end of the body, and at least one of the first end plate and the second end plate is provided with a port communicated with the water guide groove.

In some embodiments, the body includes: a first side plate including a first end and a second end in a width direction thereof, at least a part of the first side plate being in contact with one of the first straight portion and the second straight portion; a second side plate, one end of the second side plate being connected to the first end of the first side plate, and the second side plate being located in the gap between the first straight portion and the second straight portion; a third side plate, one end of the third side plate being connected to the second end of the first side plate, the other end of the third side plate being a free end, the third side plate and the second side plate being arranged opposite to each other in the width direction of the first side plate, and the third side plate being located in the groove portion; and a fourth side plate arranged at the other end of the second side plate, at least a part of the fourth side plate being in contact with the other one of the first straight portion and the second straight portion. The water guide groove is defined by the third side plate, the first side plate, the second side and the fourth side plate, or defined by the first side plate, the third side plate and the second side plate.

In some embodiments, the first side plate includes a first section and a second section, one end of the first section is connected to the third side plate, the first section is inclined toward the one of the first straight portion and the second straight portion in a direction from the third side plate to the second side plate, the second section is inclined from the other end of the first section toward the one of the first straight portion and the second straight portion in the direction from the third side plate to the second side plate, an inclination angle of the second section is greater than an inclination angle of the first section, and at least a part of the second section is in contact with the one of the first straight portion and the second straight portion.

In some embodiments, a surface of the second section away from the fourth side plate is in contact with the one of the first straight portion and the second straight portion; or, an end of the second section away from the first section is in contact with the one of the first straight portion and the second straight portion, and a juncture between the one of the first straight portion and the second straight portion and the bent portion is in contact with the first section.

In some embodiments, the first side plate is a straight plate, and a juncture between the one of the first straight portion and the second straight portion and the bent portion is in contact with the first side plate.

In some embodiments, wherein the second side plate is arranged at an end of the second section away from the first section; or, the second side plate is arranged at a juncture between the first section and the second section.

In some embodiments, a surface of the fourth side plate away from the first side plate is in contact with the other one of the first straight portion and the second straight portion, and the water guide groove is defined by the first side plate, the third side plate and the second side plate; or, an end of the fourth side plate away from the second side plate is in contact with the other one of the first straight portion and the second straight portion, and the water guide groove is defined by the first side plate, the third side plate, the second side plate and the fourth side plate; or, a juncture between the other one of the first straight portion and the second straight portion and the bent portion is in contact with the fourth side plate, and the water guide groove is defined by the first side plate, the third side plate, the second side plate and the fourth side plate.

In some embodiments, the second side plate has an arc-shaped cross section, one end of the second side plate is in contact with the one of the first straight portion and the second straight portion, and the other end of the second side plate is in contact with the other one of the first straight portion and the second straight portion.

In some embodiments, the body includes: a first side plate including a first end and a second end in a width direction thereof; a second side plate including a first end section, a second end section, and a connecting portion connected between the first end section and the second end section of the second side plate, the connecting portion of the second side plate being connected to the first end of the first side plate, and the second side plate being located in the gap between the first straight portion and the second straight portion; a third side plate including a first end section, a second end section, and a connecting portion connected between the first end section and the second end section of the third side plate, the connecting portion of the third side plate being connected to the second end of the first side plate, and the third side plate being located in the groove portion; a fourth side plate connected to the first end section of the second side plate, at least a part of the fourth side plate being in contact with the other one of the first straight portion and the second straight portion; and a fifth side plate connected to the second end section of the second side plate, at least a part of the fifth side plate being in contact with one of the first straight portion and the second straight portion. Two water guide grooves are provided, one water guide groove is defined by the first end section of the second side plate, the first side plate, and the first end section of the third side plate, and the other water guide groove is defined by the second end section of the second side plate, the first side plate, and the second end section of the third side plate; or, one water guide groove is defined by the first end section of the third side plate, the first side plate, the first end section of the second side plate and the fourth side plate, and the other water guide groove is defined by the second end section of the third side plate, the first side plate, the second end section of the second side plate, and the fifth side plate.

In some embodiments, a surface of the fourth side plate away from the second side plate is in contact with the one of the first straight portion and the second straight portion, and/or a surface of the fifth side plate away from the second side plate is in contact with the other one of the first straight portion and the second straight portion; or, an end of the fourth side plate away from the second side plate is in contact with the one of the first straight portion and the second straight portion, and/or an end of the fifth side plate away from the second side plate is in contact with the other one of the first straight portion and the second straight portion.

In some embodiments, the fourth side plate extends from a first end of the second side plate in a direction of the third side plate, and the fifth side plate extends from a second end of the second side plate in the direction of the third side plate; or, the fourth side plate extends from a first end of the second side plate in a direction running away from the third side plate, and the fifth side plate extends from a second end of the second side plate in the direction running away from the third side plate.

In some embodiments, the body includes: a first side plate including a first end and a second end in a width direction thereof, at least a part of the first side plate is in contact with one of the first straight portion and the second straight portion; a second side plate, one end of the second side plate being connected to the first end of the first side plate, the second side plate being located in the gap between the first straight portion and the second straight portion, and the other end of the second side plate being in contact with the other one of the first straight portion and the second straight portion; and a third side plate, one end of the third side plate being connected to the second end of the first side plate, the other end of the third side plate being a free end, the third side plate and the second side plate being arranged opposite to each other in the width direction of the first side plate, and the third side plate being located in the groove portion. The water guide groove is defined by the second side plate, the first side plate and the third side plate.

In some embodiments, an end face of the other end of the second side plate is in contact with the other one of the first straight portion and the second straight portion.

In some embodiments, a thickness of the second side plate is greater than a thickness of the third side plate.

In some embodiments, the body includes: a first side plate including a first end and a second end in a width direction thereof; a second side plate including a first end section, a second end section, and a connecting portion connected between the first end section and the second end section of the second side plate, the connecting portion of the second side plate being connected to the first end of the first side plate, the second side plate being located in the gap between the first straight portion and the second straight portion, an end face of an end of the first end section of the second side plate away from the connecting portion of the second side plate being in contact with the other one of the first straight portion and the second straight portion, and an end face of an end of the second end section of the second side plate away from the connecting portion of the second side plate being in contact with one of the first straight portion and the second straight portion; and a third side plate including a first end section, a second end section, and a connecting portion connected between the first end section and the second end section of the third side plate, the connecting portion of the third side plate being connected to the second end of the first side plate, and the third side plate being located in the groove portion. Two water guide grooves are provided, one water guide groove is defined by the first end section of the second side plate, the first side plate and the first end section of the third side plate, and the other water guide groove is defined by the second end section of the second side plate, the first side plate and the second end section of the third side plate.

In some embodiments, the body has an arc-shaped cross section, an opening of the water guide groove is located in the groove section, a juncture between the first straight portion and the bent portion is in contact with an outer surface of the water guider, and a juncture between the second straight portion and the bent portion is in contact with the outer surface of the body.

In some embodiments, the heat exchanger is a flat plate heat exchanger, and the water guider is arranged at a substantially middle position of the flat plate heat exchanger in a height direction of the flat plate heat exchanger.

A heat exchange device according to an embodiment of the present disclosure is described below.

As shown in FIGS. 1 to 9, the heat exchange device according to the embodiment of the present disclosure includes a heat exchanger 1 and a water guider 2, the water guider 2 is arranged on the heat exchanger 1 and has a water guide groove 201, and condensed water on at least a part of the heat exchanger 1 can flow out through the water guide groove 201. It can be understood that the water guide groove 201 has an opening, and the opening of the water guide groove 201 opens toward the at least part of the heat exchanger 1, such that the condensed water on the at least part of the heat exchanger 1 can enter the water guide groove 201 through the opening of the water guide groove 201.

In some embodiments, the heat exchange device further includes a water receiving tray 3 into which the condensed water in the water guide groove 201 can flow.

According to the heat exchange device in the embodiment of the present disclosure, since the water guider 2 having the water guide groove 201 is arranged on the heat exchanger 1, the condensed water on the at least part of the heat exchanger 1 can be guided out, which facilitates drainage and avoids a water blowing phenomenon, thereby improving the reliability and comfort of a product.

Moreover, a water film can be prevented from being formed on flat tubes and fins of the heat exchanger 1, thereby ensuring an effective heat exchange area and a heat exchange efficiency of the heat exchanger 1.

In some embodiments, a length direction of the water guider 2 is substantially parallel to a width direction of the heat exchanger 1. In other words, a length of the water guider 2 substantially extends in the width direction of the heat exchanger 1, that is, the length direction of the water guider 2 is substantially identical with the width direction of the heat exchanger 1.

In some embodiments, a length direction of the water guide groove 201 is substantially parallel to the length direction of the water guider 2. In other words, a length of the water guide groove 201 substantially extends in the length direction of the water guider 2, that is, the length direction of the water guide groove 201 is substantially identical the length direction of the water guider 2. Therefore, the length direction of the water guide groove 201 is substantially identical with the width direction of the heat exchanger 1, and the condensed water on a part of the heat exchanger 1, which is located above the water guide groove 201, can flow into the water guide groove 201 and be discharged through the water guide groove 201.

It can be understood that the present disclosure is not limited to parallelism. For example, the heat exchanger 1 has a first end and a second end in the width direction thereof, the water guider 2 extends in a direction from the first end to the second end of the heat exchanger 1 and is inclined downward, and the water guide groove 201 extends in the direction from the first end to the second end of the heat exchanger 1 and is inclined downward, such that the condensed water flowing into the water guide groove 201 flows out from a relatively low side of the water guide groove 201. Alternatively, the water guide groove 201 includes a first section, a second section, and a joint connecting the first section with the second section in the width direction of the heat exchanger 1, the first section extends from the joint along the width direction of the heat exchanger 1 and a direction running away from the second section, and is inclined downward, and the second section extends from the joint along the width direction of the heat exchanger 1 and a direction running away from the first section, and is inclined downward. In other words, two ends of the water guide groove 201 in the width direction of the heat exchanger 1 are lower than rest portions, such that the condensed water in the water guide groove 201 flows out of the two ends of the water guide groove 201 in the width direction of the heat exchanger 1.

In some embodiments, the heat exchanger 1 includes a plurality of heat exchange tubes which are arranged at intervals, and a plurality of water guiders 2 are provided and arranged at intervals in a length direction of the heat exchange tube. In the descriptions of the present disclosure, unless otherwise specifically limited, the term "plurality of" means at least two, such as two, three, etc.

For the length direction of the heat exchange tube, it should be noted that in a bent heat exchanger, each heat exchange tube includes two straight sections and a bent section located between the straight sections, and the length direction of the heat exchange tube refers to a direction that extends from an end of one straight section in its length direction to the bent section and then to an end of the other straight section in its length direction away from the bent section; and in a flat plate heat exchanger, the length direction of the heat exchange tube refers to a height direction of the flat plate heat exchanger.

In some embodiments, the heat exchanger 1 includes a first header 11, a second header 12 and a plurality of flat tubes 13, and the first header 11 is arranged parallel to the second header 12. As shown in FIG. 1, the first header 11 and the second header 12 both extend in a front-rear direction, and are spaced apart from and arranged opposite to each other in an up-down direction.

Each flat tube 13 includes a first straight section 131, a second straight section 132 and a bent section 133, one end of the first straight section 131 is connected to the first header 11, the other end of the first straight section 131 is connected to one end of the bent section 133, the other end of the bent section 133 is connected to one end of the second straight section 132, and the other end of the second straight section 132 is connected to the second header 12.

The bent section 133 is twisted at a predetermined torsion angle relative to the first straight section 131 and the second straight section 132 around a length direction of the flat tube 13, and the flat tube 13 is bent at the bent section 133 such that a predetermined included angle is formed between the first straight section 131 and the second straight section 133.

As shown in FIG. 1, the first straight section 131 is inclined downward from right to left, the second straight section 132 is inclined downward from left to right, and the bent section 133 is connected between the left end of the first straight section 131 and the left end of the second straight section 132. The bent section 133 is formed by twisting and then bending the straight flat tube 13 around the length direction of the flat tube 13 at a position where the bent section 133 is located. In some embodiments, the heat exchanger 1 further includes fins (not shown) which are respectively provided between the first straight sections 131 of adjacent flat tubes 13 and between the second straight sections 132 of adjacent flat tubes 13. In other words, the fins are arranged between the first straight sections 131 of adjacent flat tubes 13 and between the second straight sections 132 of adjacent flat tubes 13, but are not arranged between the bent sections 133 of adjacent flat tubes 13.

The water guider 2 is arranged between the first straight section 131 and the second straight section 132. The condensed water on the heat exchanger 1 can flow from an upper part of the heat exchanger 1 to a contact point between the heat exchanger 1 and the water guider 2, then to the water guide groove 201, and be discharged through the water guide groove 201.

Figure 2:
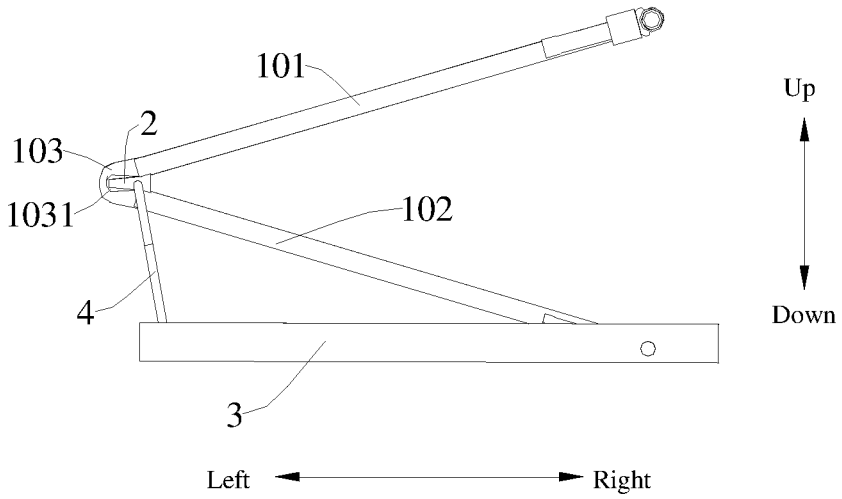
FIG. 2 is a side view of the heat exchanger device in FIG. 1.
Figure 3:
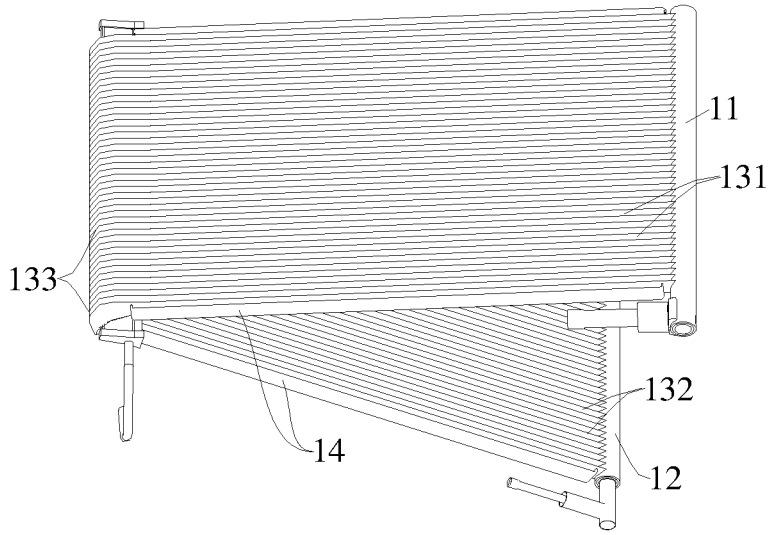
FIG. 3 is a schematic view of the heat exchange device in FIG. 1, in which a water receiving tray is not shown.

In some embodiments, the heat exchanger 1 includes a first straight portion 101, a second straight portion 102 and a bent portion 103, the first straight portion 101 includes the first straight sections 131 of the plurality of flat tubes 13, and the second straight portion 102 includes the second straight sections 132 of the plurality of flat tubes 13. As shown in FIGS. 1 to 3, the heat exchanger 1 further includes side plates 14, which are respectively provided on both sides of the first straight sections 131 of the plurality of flat tubes 13 in a front-rear direction and on both sides of the second straight sections 131 of the plurality of flat tubes 13 in the front-rear direction. The first straight portion 101 includes the first straight sections 131 of the plurality of flat tubes 13, the fins arranged between the first straight sections 131 of adjacent flat tubes 13, and the side plates 14 arranged on both sides of the first straight sections 131 of the plurality of flat tubes 13. The second straight portion 102 includes the second straight sections 132 of the plurality of flat tubes 13, the fins arranged between the second straight sections 132 of adjacent flat tubes 13, and the side plates 14 arranged on both sides of the first straight sections 131 of the plurality of flat tubes 13.

The bent portion 103 includes the bent sections 133 of the plurality of flat tubes 13, and is provided with a groove portion 1031 that opens toward a gap between the first straight portion 101 and the second straight portion 102. As shown in FIGS. 1 to 3, a groove is formed after the bent section 103 of each flat tube 13 is twisted and bent, and an opening of the groove is communicated with a gap between the first straight section 131 and the second straight section 132. That is, the opening of the groove faces the gap between the first straight section 131 and the second straight section 132. The grooves of the plurality of flat tubes 13 are communicated with one another to form the groove portion 1031.

A first end of the water guider 2 in its width direction is provided between the first straight portion 101 and the second straight portion 102 and is in contact with the first straight portion 101 and the second straight portion 102, respectively, and a second end of the water guider 2 in its width direction extends to the groove portion 1031. As shown in FIGS. 1 to 3, the width direction of the water guider 2 is a left-right direction. A right end of the water guider 2 is arranged between the first straight portion 101 and the second straight portion 102, and the right end of the water guider 2 is in contact with both the first straight portion 101 and the second straight portion 102.

In other words, the water guider 2 is mounted between the first straight portion 101 and the second straight portion 102 and extends into the groove portion 1031 formed by the bent sections 133 of the plurality of flat tubes 13. As shown in FIGS. 1 to 3, by mounting the water guider 2 on the heat exchanger 1, the condensed water on the first straight portion 101 can be guided into the water guide groove 201 of the water guider 2 and flow into the water receiving tray 3 through the water guide groove 201, thereby achieving a good drainage performance.

Further, a length extension direction of the groove portion 1031 is identical with an axial direction of the first header 11, and a length extension direction of the water guider 2 is identical with the length extension direction of the groove portion 1031. The water guide groove 201 extends in the length extension direction of the water guider 2. In other words, the groove portion 1031 extends along a width of the heat exchanger 1, and the water guider 2 is provided with the groove portion 1031 along the width direction of the heat exchanger 1.

As shown in FIGS. 1 to 3, a length direction of the groove portion 1031, the length direction of the water guider 2, and the length direction of the water guide groove 201 are all the front-rear direction.

It can be understood that the position of the water guider 2 is not limited to this in the present disclosure. The water guider 2 may also be arranged at the first straight portion 101, and the condensed water on a part of the first straight portion 101, which is located above the water guider 2, can flow into the water guide groove 201 and flow out through the water guide groove 201. The water guider 2 may also be arranged at the second straight portion 102, and the condensed water on a part of the second straight portion 102, which is located above the water guider 2, can flow into the water guide groove 201 and flow out through the water guide groove 201.

However, the inventor has found that since the fins are arranged both between the first straight sections 131 of adjacent flat tubes 13 and between the second straight sections 132 of adjacent flat tubes 13, but are not arranged between the bent sections 133 of adjacent flat tubes 13, a part of airflow can flow from a gap between adjacent bent sections 133 to an area between the first straight portion 101 and the second straight portion 102 during use of the heat exchanger 1, resulting in air leakage, which affects the air flowing of the heat exchanger 1 and reduces the heat exchange efficiency.

Therefore, in some embodiments, the first end of the water guider 2 in its width direction is arranged between the first straight portion 101 and the second straight portion 102 and is in contact with the first straight portion 101 and the second straight portion 102, respectively, and the second end of the water guider 2 in its width direction extends to the groove portion 1031. The water guider 2 is in contact with the first straight portion 101 and the second straight portion 102 to block a part of the airflow from flowing through the gap between adjacent bent sections 133 to the area between the first straight portion 101 and the second straight portion 102, thereby avoiding the air leakage of the heat exchanger 1 and improving the heat exchange efficiency.

It can be understood that the flat tube 13 may further include a plurality of bent sections 133, and the heat exchanger 1 includes a plurality of bent portions 103. Each bent portion 103 may correspond to one water guider 2.

In some embodiments, the water guider 2 includes a body 21, and the water guide groove 201 penetrates through the body 21 along a length direction of the body 21, and is open on one side of the body 21 in a thickness direction of the body 21. As shown in FIGS. 1 to 3, the water guide groove 201 penetrates through the body 21 in the front-rear direction, and an opening of the water guide groove 201 faces upward.

In some embodiments, the water guider 2 further includes a first end plate 22 and a second end plate 23. The body 21 has a first end and a second end in its length direction. The first end plate 22 is arranged at the first end of the body 21, and the second end plate 23 is arranged at the second end of the body 21. At least one of the first end plate 22 and the second end plate 23 is provided with a port 24 which is communicated with the water guide groove 201.

As shown in FIGS. 4, and 7 to 9, the first end plate 22 is arranged at a front end of the body 21 to seal a front end of the water guide groove 201. The first end plate 22 is provided with the port 24, such that the condensed water in the water guide groove 201 flows into the water receiving tray 3 through the port 24. The second end plate 23 is arranged at a rear end of the body 21 to seal a rear end of the water guide groove 201. It can be understood that the second end plate 23 may be or not be provided with the port 24.

In some embodiments, a groove 220 is formed in an inner side of the first end plate 22 and is communicated with the water guide groove 201. The port 24 is communicated with the groove 220, that is, the groove 220 communicates the water guide groove 201 with the port 24.

In some embodiments, a water guide pipe 4 is connected between the water guider 2 and the water receiving tray 3. The water guide pipe 4 is connected to the port 24, such that the condensed water in the water guide groove 201 is guided into the water receiving tray 3 through the water guide pipe 4, thereby further reducing the water blowing phenomenon.

It can be understood that the present disclosure is not limited to this. For example, the first end and the second end of the body 21 of the water guider 2 of the present disclosure may not be provided with the first end plate 22 and the second end plate 23, respectively, and the condensed water flows directly into the water receiving tray 3 from the first end and/or the second end of the water guide groove 201.

In some embodiments, as shown in FIGS. 4 to 6 and 10 to 19, the body 21 includes a first side plate 211, a second side plate 212, a third side plate 213, and a fourth side plate 214. The first side plate 211 includes a first end and a second end in its width direction, and at least a part of the first side plate 211 is in contact with one of the first straight portion 101 and the second straight portion 102.

One end of the second side plate 212 is connected to the first end of the first side plate 211, and the second side plate 212 is located in the gap between the first straight portion 101 and the second straight portion 102. The fourth side plate 214 is arranged at the other end of the second side plate 212, and at least a part of the fourth side plate 214 is in contact with the other one of the first straight portion 101 and the second straight portion 102.

One end of the third side plate 213 is connected to the second end of the first side plate 211, the other end of the third side plate 213 is a free end, the third side plate 213 and the second side plate 212 are arranged opposite to each other in the width direction of the first side plate 211, and the third side plate 213 is located in the groove portion 1031.

The water guide groove 201 is defined by the third side plate 213, the first side plate 211, the second side plate 212 and the fourth side plate 214, or defined by the first side plate 211, the third side plate 213 and the second side plate 212.

As shown in FIGS. 4 to 6 and 10 to 20, the width direction of the first side plate 211 is the left-right direction. A right side part of the first side plate 211 is in contact with the second straight portion 102. The second side plate 212 is arranged at a right end of the first side plate 211 and is located in the gap between the first straight portion 101 and the second straight portion 102. The third side plate 213 is arranged at a left end of the first side plate 211 and is located in the groove portion 1031. The fourth side plate 214 is connected to an upper end of the second side plate 212, and at least a part of an upper surface of the fourth side plate 214 is in contact with the first straight portion 101.

In some specific embodiments, as shown in FIGS. 4 to 6 and 10 to 15, the first side plate 211 includes a first section 2111 and a second section 2112, one end of the first section 2111 is connected to the third side plate 213, one end of the second section 2112 is connected to the other end of the first section 2111, the second section 2112 is inclined from the other end of the first section 2111 toward the second straight portion 102 in a direction from the third side plate 213 to the second side plate 212, and at least a part of the second section 2112 is in contact with the second straight portion 102.

As shown in FIGS. 4 to 6 and 10 to 15, the first side plate 211 includes the first section 2111 and the second section 2112 that are sequentially connected from left to right, the second section 2112 of the first side plate 211 is inclined downward in a direction from left to right, and at least a part of a lower surface of the second section 2112 is in contact with the second straight portion 102.

Further, the first section 2111 is inclined toward the second straight portion 102 in the direction from the third side plate 213 to the second side plate 212, and an inclination angle of the second section 2112 is greater than that of the first section 2111, that is, the second section 2112 is inclined toward the second straight portion 102 relative to the first section 2111. As shown in FIGS. 4 to 6 and 10 to 15, the first section 2111 of the first side plate 211 is inclined downward in the direction from left to right, the second section 2112 of the first side plate 211 is inclined downward in the direction from left to right, and the inclination angle of the second section 2112 is greater than that of the first section 2111, that is, the second section 2112 is inclined downward relative to the first section 2111.

Figure 4:
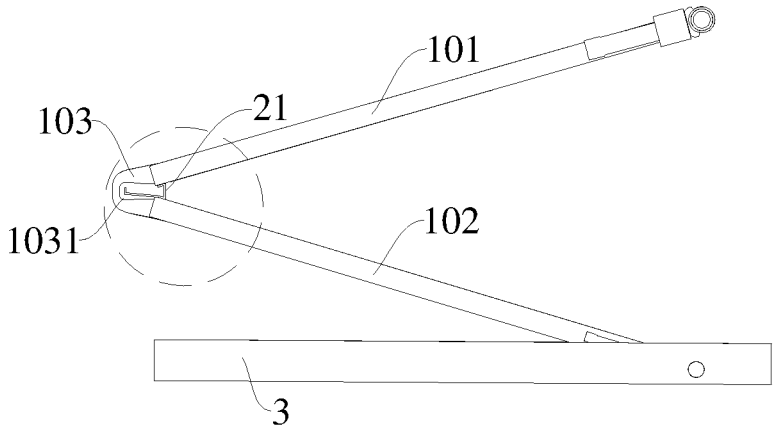
FIG. 4 is a side view of a first embodiment of the heat exchange device in FIG. 1.
Figure 5:
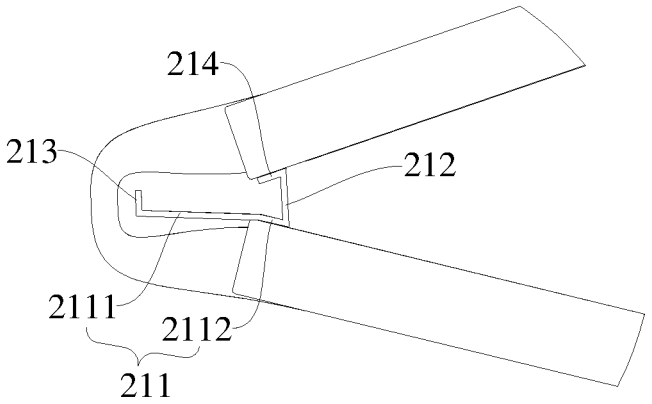
FIG. 5 is a partially enlarged view of part A in FIG. 4.
Figure 6:
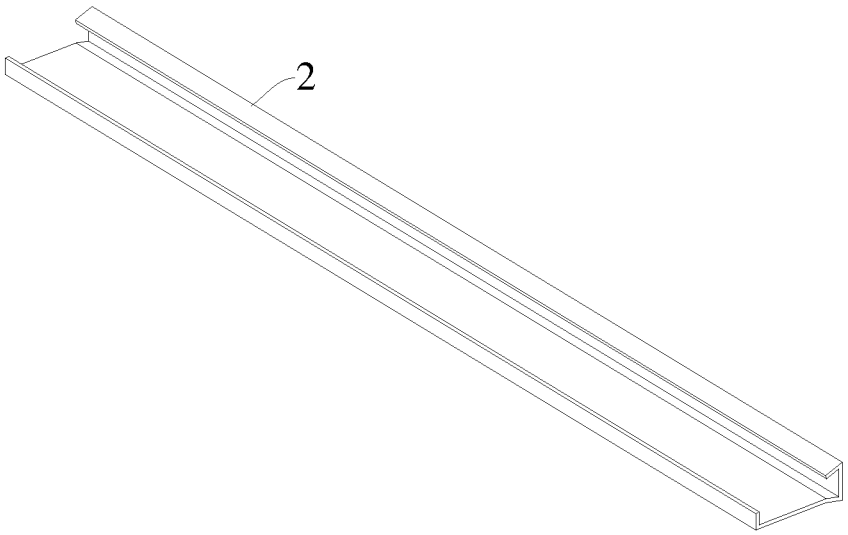
FIG. 6 is a schematic view of a body of a water guider in FIG. 4.
Figure 7:
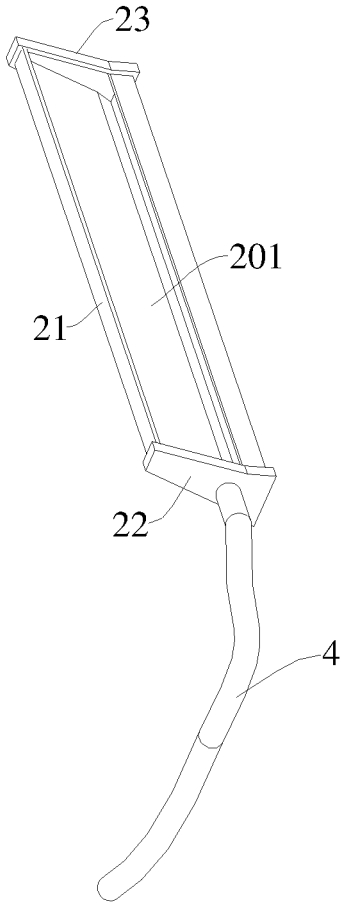
FIG. 7 is a schematic view of a water guider and a water guide pipe fitted with each other in FIG. 1.
Figure 8:
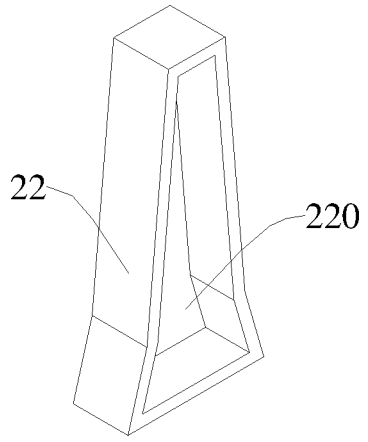
FIG. 8 is a schematic view of a first end plate or a second end plate of a water guider in FIG. 1 from an angle.
Figure 9:
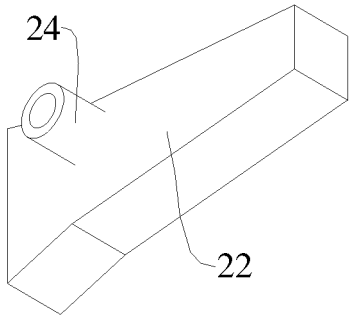
FIG. 9 is a schematic view of a first end plate or a second end plate of a water guider in FIG. 1 from another angle.

In the embodiments shown in FIGS. 4 to 6, the second side plate 212 is arranged at a right end of the second section 2112 of the first side plate 211. In other words, a lower end of the second side plate 212 is connected to the right end of the second section 2112 of the first side plate 211.

The third side plate 213 and a large left side part of the first section 2111 of the first side plate 211 are located in the groove portion 1031. The fourth side plate 214 is arranged at the upper end of the second side plate 212 and extends toward the third side plate 213. In other words, the fourth side plate 214 extends leftward and is inclined downward from the upper end of the second side plate 212, and a gap is formed between the fourth side plate 214 and the third side plate 213 to form the opening of the water guide groove 201.

A juncture between the first section 2111 and the second section 2112 of the first side plate 211, the second section 2112, the second side plate 212, and the fourth side plate 214 are all located in the gap between the first straight portion 101 and the second straight portion 102. A lower surface of the juncture between the first section 2111 and the second section 2112 of the first side plate 211 and the entire lower surface of the second section 2112 are in contact with the second straight portion 102. The entire upper surface of the fourth side plate 214 is in contact with the first straight portion 101.

The water guide groove 201 is defined by the third side plate 213, the first side plate 211, the second side plate 212 and the fourth side plate 214.

In the embodiments shown in FIGS. 10 to 15, the lower end of the second side plate 212 is connected to the juncture between the first section 2111 and the second section 2112 of the first side plate 211. The third side plate 213 and a large left side part of the first section 2111 of the first side plate 211 are located in the groove portion 1031. The fourth side plate 214 is arranged at the upper end of the second side plate 212 and extends in a direction running away from the third side plate 213. In other words, the fourth side plate 214 extends rightward and is inclined upward from the upper end of the second side plate 212.

A small right side part of the first section 2111 and the second section 2112 of the first side plate 211, the second side plate 212, and the fourth side plate 214 are all located in the gap between the first straight portion 101 and the second straight portion 102.

Figure 10:
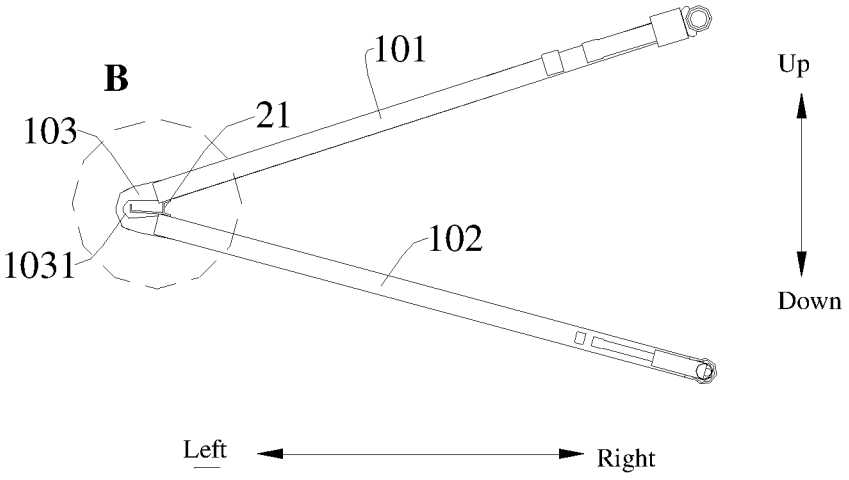
FIG. 10 is a side view of a second embodiment of the heat exchange device in FIG. 1.
Figure 11:
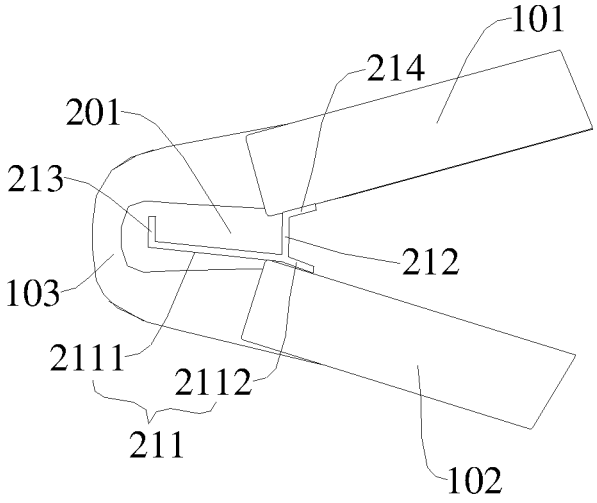
FIG. 11 is a partially enlarged view of part B in FIG. 10.
Figure 12:
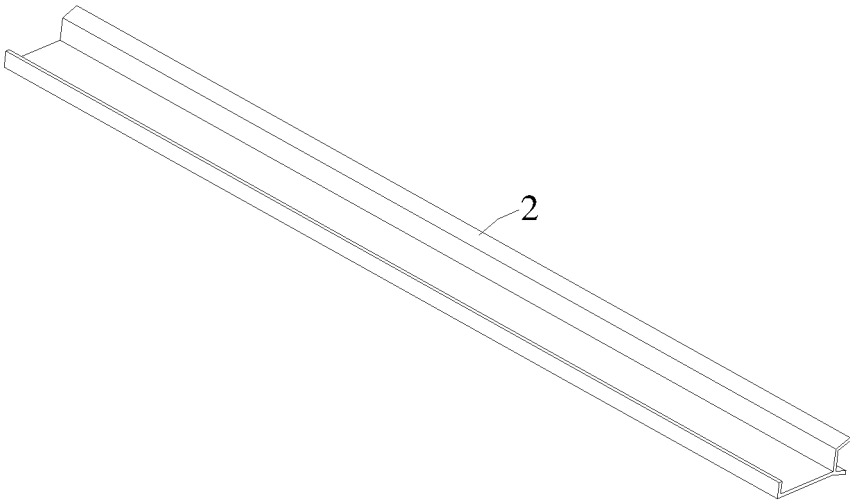
FIG. 12 is a schematic view of a body of a water guider in FIG. 10.

In the embodiments shown in FIGS. 10 to 12, a juncture between the second straight portion 102 and the bent portion 103 is in contact with a lower surface of the first section 2111, and a part of the lower surface of the second section 2112 is in contact with the second straight portion 102. The entire upper surface of the fourth side plate 214 is in contact with the first straight portion 101. The water guide groove 201 is defined by the third side plate 213, the first side plate 211 and the second side plate 212.

It should be noted here that the bent portion 103 is not provided with the fins, and the first straight portion 101 and the second straight portion 102 both are provided with the fins, so the heat exchanger 1 includes a finned area and an un-finned area. The finned area includes a first fin area and a second fin area, the first fin area corresponds to the first straight portion 101, and the second fin area corresponds to the second straight portion 102. In this case, the juncture of the first straight portion 101 and the bent portion 103 may be interpreted as a juncture of the first fin area and the un-finned area, and the juncture of the second straight portion 102 and the bent portion 103 may be interpreted as a juncture of the second fin area and the un-finned area.

Specifically, an edge is provided between the lower surface of the second section 2112 and a right surface of the second section 2112, and the edge is in contact with the second straight portion 102.

Figure 13:
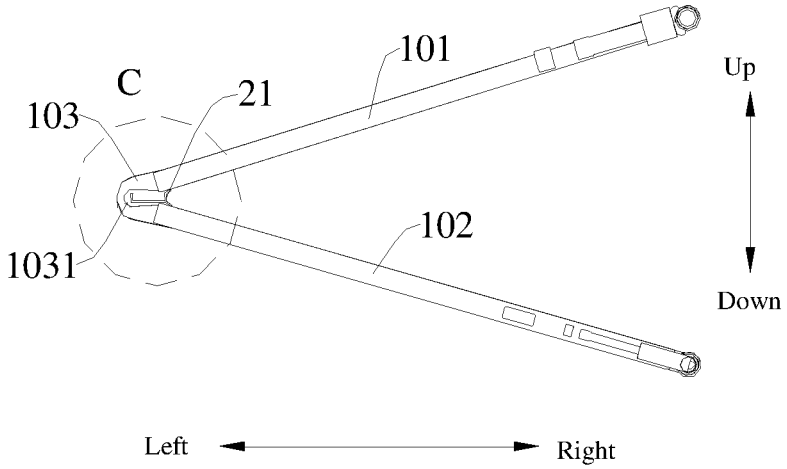
FIG. 13 is a side view of a third embodiment of the heat exchange device in FIG. 1.
Figure 14:
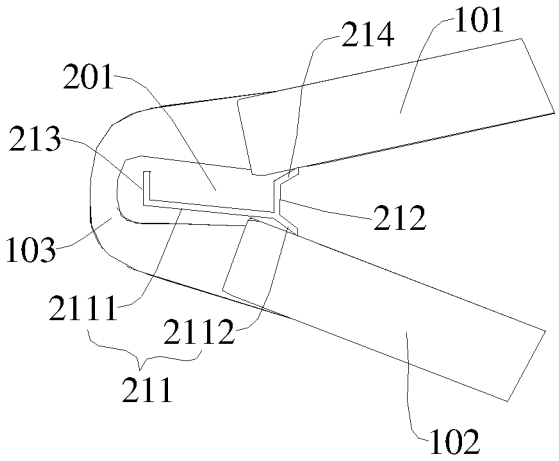
FIG. 14 is a partially enlarged view of part C in FIG. 13.
Figure 15:
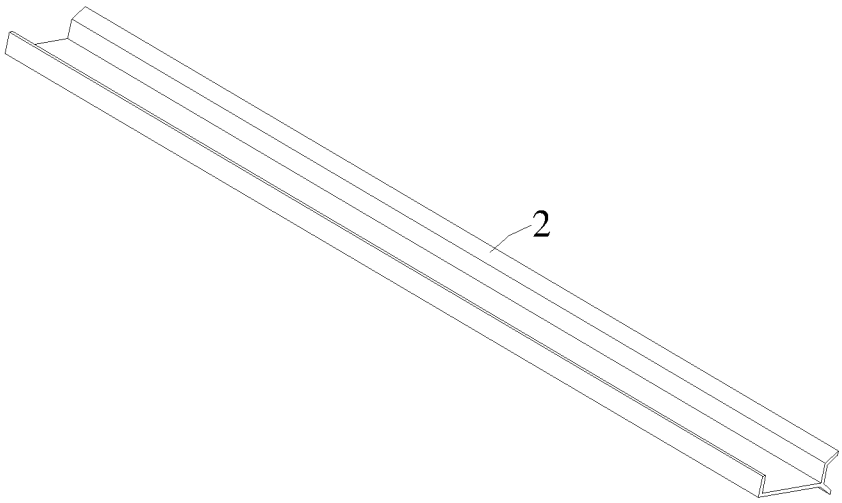
FIG. 15 is a schematic view of a body of a water guider in FIG. 13.

In the embodiments shown in FIGS. 13 to 15, only a part of the lower surface of the second section 2112 is in contact with the second straight portion 102. A part of the upper surface of the fourth side plate 214 is in contact with the first straight portion 101. The water guide groove 201 is defined by the third side plate 213, the first side plate 211, the second side plate 212 and the fourth side plate 214.

Specifically, an edge is provided between the lower surface of the second section 2112 and the right surface of the second section 2112, and the edge is in contact with the second straight portion 102. An edge is provided between the upper surface of the fourth side plate 214 and a right surface of the fourth side plate 214, and the edge is in contact with the first straight portion 101.

In some specific embodiments, the first side plate 211 is inclined toward the second straight portion 102 in the direction from the third side plate 213 to the second side plate 212, and a part of the first side plate 211 is in contact with the second straight portion 102.

Figure 16:
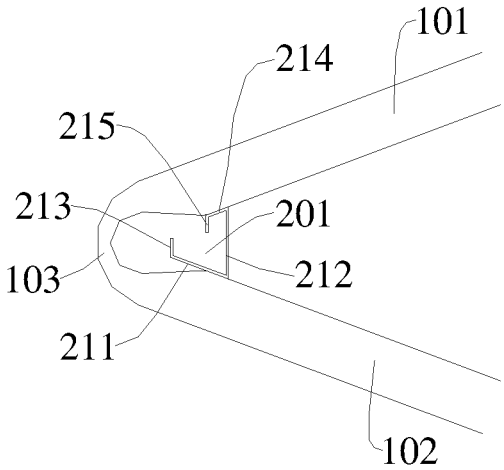
FIG. 16 is a partial schematic view of a fourth embodiment of the heat exchange device in FIG. 1.

As shown in FIG. 16, the first side plate 211 is inclined downward in the direction from left to right. The third side plate 213 and a large left side part of the first side plate 211 are located in the groove portion 1031. The fourth side plate 214 extends leftward and is inclined downward from the upper end of the second side plate 212, and a small right side part of the first side plate 211 and the second side plate 212 are located in the gap between the first straight portion 101 and the second straight portion 102.

A lower surface of the small right side part of the first side plate 211 is in contact with the second straight portion 102, and the entire upper surface of the fourth side plate 214 is in contact with the first straight portion 101.

In some embodiments, as shown in FIG. 16, the body 21 further includes a fifth side plate 215, which extends downward from a left end of the fourth side plate 214, and the fifth side plate 215 and the third side plate 213 are spaced apart in the left-right direction to form the opening of the water guide groove 201. Further, a juncture between the first straight portion 101 and the bent portion 103 is arranged opposite to the fifth side plate 215 in the up-down direction. The water guide groove 201 is defined by the third side plate 213, the first side plate 211, the second side plate 212, the fourth side plate 214 and the fifth side plate 215.

In some specific embodiments, the first side plate 211 is inclined toward the second straight portion 102 in the direction from the third side plate 213 to the second side plate 212, and a part of the first side plate 211 is in contact with the second straight portion 102.

Figure 17:
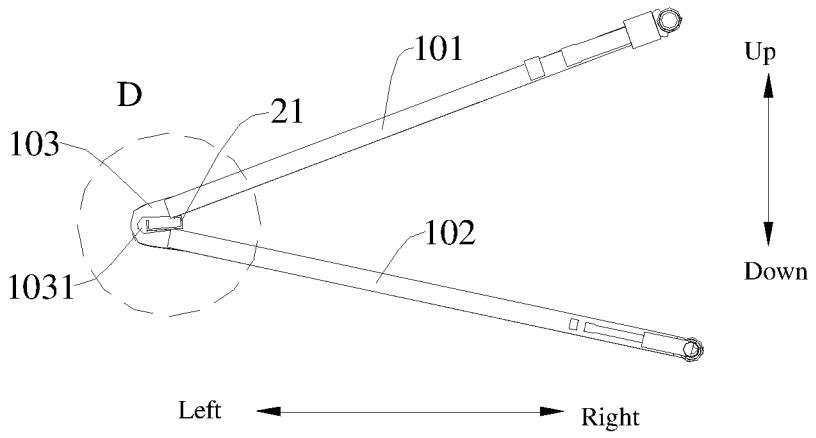
FIG. 17 is a side view of a fifth embodiment of the heat exchange device in FIG. 1.
Figure 18:
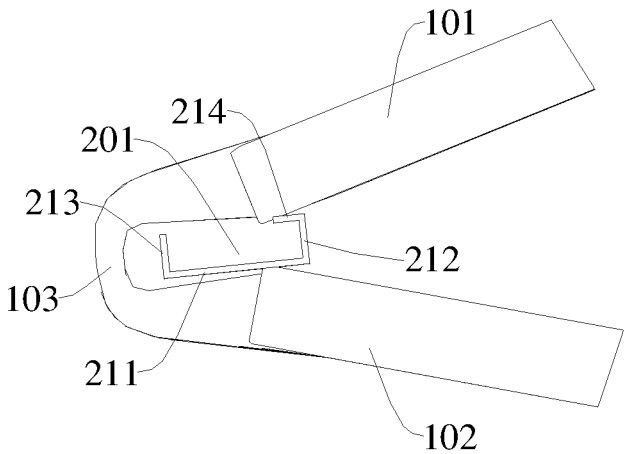
FIG. 18 is a partially enlarged view of part D in FIG. 17.
Figure 19:
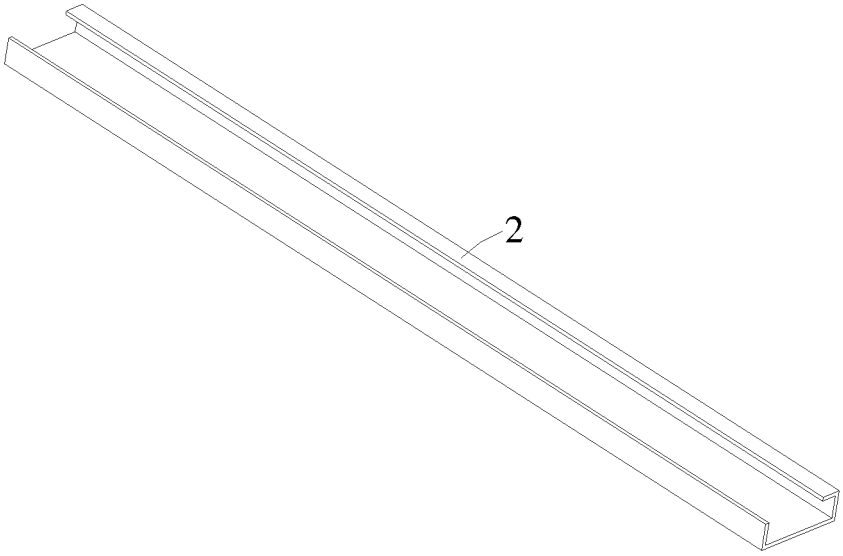
FIG. 19 is a schematic view of a body of a water guider in FIG. 17.

As shown in FIGS. 17 to 19, the first side plate 211 is inclined upward in the direction from left to right. The third side plate 213 and a large left side part of the first side plate 211 are located in the groove portion 1031. The fourth side plate 214 is provided at an upper end of the second side plate 212 and extends toward the third side plate 213. In other words, the fourth side plate 214 extends leftward and is inclined downward from the upper end of the second side plate 212, and a gap is formed between the fourth side plate 214 and the third side plate 213 to form the opening of the water guide groove 201.

A small right side part of the first side plate 211, the second side plate 212, and the fourth side plate 214 are all located in the gap between the first straight portion 101 and the second straight portion 102. The juncture between the second straight portion 102 and the bent portion 103 is in contact with the first side plate 211. A part of an upper surface of the fourth side plate 214 is in contact with the first straight portion 101. The water guide groove 201 is defined by the third side plate 213, the first side plate 211, the second side plate 212 and the fourth side plate 214.

Specifically, an edge is provided between the upper surface of the fourth side plate 214 and a left surface of the fourth side plate 214, and the edge is in contact with the first straight portion 101.

Figure 20:
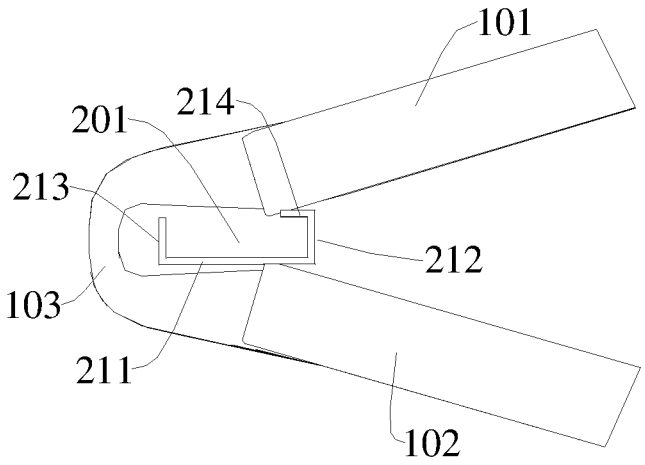
FIG. 20 is a partial schematic view of a sixth embodiment of the heat exchange device in FIG. 1.

It can be understood that the first side plate 211 may also extend horizontally from left to right, as shown in FIG. 20.

In some specific embodiments, as shown in FIGS. 4 to 6 and 10 to 20, the second side plate 212 is arranged adjacent to the juncture between the first straight portion 101 and the bent portion 103 and the juncture between the second straight portion 102 and the bent portion 103.

A distance between the second side plate 212 and the third side plate 213 in the embodiment shown in FIG. 16 is smaller than a distance between the second side plate 212 and the third side plate 213 in the embodiments shown in FIGS. 4 to 6, 10 to 15, and 17 to 20.

Figure 21:
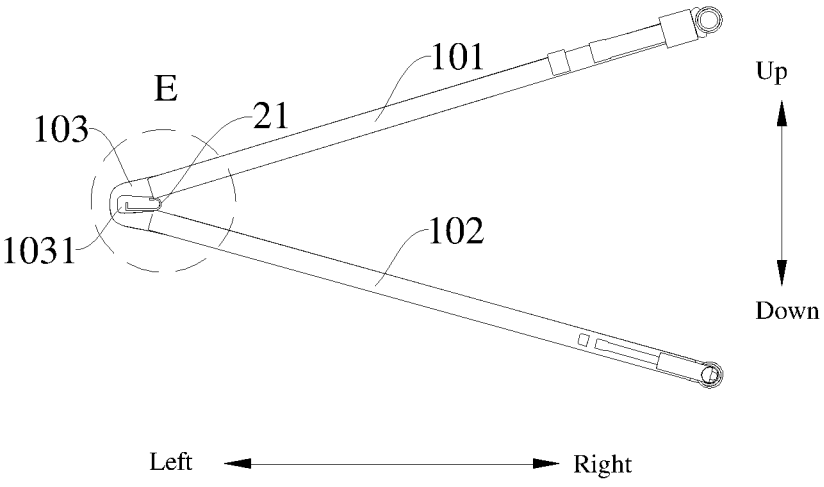
FIG. 21 is a side view of a seventh embodiment of the heat exchange device in FIG. 1.
Figure 22:
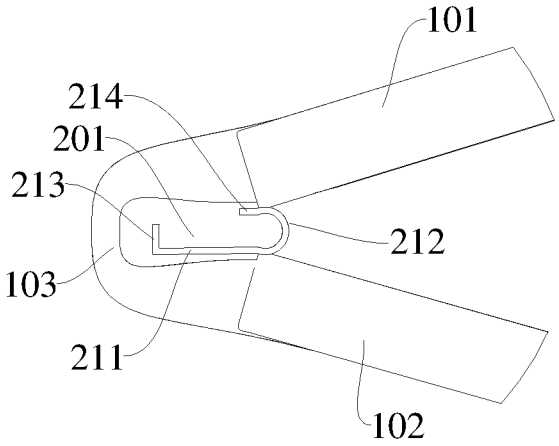
FIG. 22 is a partially enlarged view of part E in FIG. 21.
Figure 23:
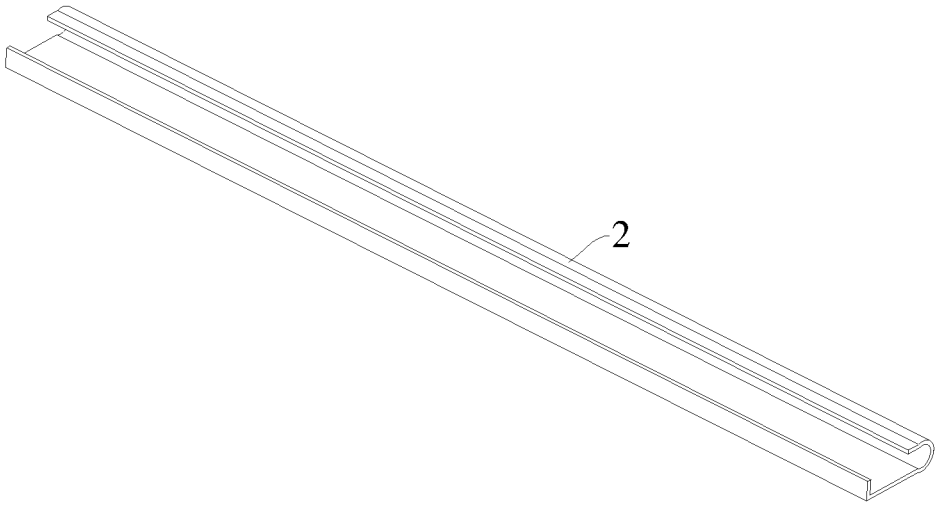
FIG. 23 is a schematic view of a body of a water guider in FIG. 21.

In some other embodiments, as shown in FIGS. 21 to 23, the body 21 includes a first side plate 211, a second side plate 212, a third side plate 213, and a fourth side plate 214. The first side plate 211 includes a first end and a second end in its width direction.

One end of the second side plate 212 is connected to the first end of the first side plate 211, the second side plate 212 is located in the gap between the first straight portion 101 and the second straight portion 102, and the second side plate 212 has an arc-shaped cross section. The juncture between the second straight portion 102 and the bent portion 103 is in contact with the one end of the second side plate 212, and the juncture between the first straight portion 101 and the bent portion 103 is in contact with the other end of the second side plate 212.

The fourth side plate 214 is arranged at the other end of the second side plate 212 and located in the groove portion 1031.

One end of the third side plate 213 is connected to the second end of the first side plate 211, the other end of the third side plate 213 is a free end, and the third side plate 213 is located in the groove portion 1031.

The water guide groove 201 is defined by the third side plate 213, the first side plate 211, the second side plate 212 and the fourth side plate 214, or defined by the first side plate 211, the third side plate 213 and the second side plate 212.

As shown in FIGS. 21 to 23, the third side plate 213 extends upward from the left end of the first side plate 211 and is located in the groove portion 1031. The second side plate 212 is in a shape of an arc protruding rightward, and is generally a semicircular tube. The second side plate 212 is located in the gap between the first straight portion 101 and the second straight portion 102. An upper end of the second side plate 212 is connected to a right end of the fourth side plate 214, and the juncture between the first straight portion 101 and the bent portion 103 is in contact with the upper end of the second side plate 212. A lower end of the second side plate 212 is connected to the first side plate 211, and the juncture between the second straight portion 102 and the bent portion 103 is in contact with the lower end of the second side plate 212.

In still other embodiments, as shown in FIGS. 24 to 36, the body 21 includes a first side plate 211, a second side plate 212, a third side plate 213, a fourth side plate 214, and a fifth side plate 215. The first side plate 211 includes a first end and a second end in its width direction. The second side plate 212 includes a first end section 2121, a second end section 2122, and a connecting portion 2123 connected between the first end section 2121 and the second end section 2122 of the second side plate 212. The connecting portion 2123 of the second side plate 212 is connected to the first end of the first side plate 211.

The third side plate 213 includes a first end section 2131, a second end section 2132, and a connecting portion 2133 connected between the first end section 2131 and the second end section 2132 of the third side plate 213. The connecting portion 2133 of the third side plate 213 is connected to the second end of the first side plate 211, and the third side plate 213 is located in the groove portion 1031.

The fourth side plate 214 is connected to the first end section 2121 of the second side plate 212, and at least a part of the fourth side plate 214 is in contact with the other one of the first straight portion 101 and the second straight portion 102.

The fifth side plate 215 is connected to the second end section 2122 of the second side plate 212, and at least a part of the fifth side plate 215 is in contact with one of the first straight portion 101 and the second straight portion 102.

Two water guide grooves 201 are provided, one water guide groove 201 is defined by the first end section 2121 of the second side plate 212, the first side plate 211 and the first end section 2131 of the third side plate 213, and the other water guide groove 201 is defined by the second end section 2122 of the second side plate 212, the first side plate 211 and the second end section 2132 of the third side plate 213.

Alternatively, one water guide groove 201 is defined by the first end section 2131 of the third side plate 213, the first side plate 211, the first end section 2121 of the second side plate 212, and the fourth side plate 214, and the other water guide groove 201 is defined by the second end section 2132 of the third side plate 213, the first side plate 211, the second end section 2122 of the second side plate 212 and the fifth side plate 215.

It can be understood that, in a case that one water guide groove 201 is provided, a user needs to arrange the opening of the water guide groove 201 in the heat exchange device to face upward while mounting the heat exchange device. As shown in FIGS. 1 to 6, the water guide groove 201 faces upward, and the first straight portion 101 is located above the second straight portion 102. In order to free the mounting of the heat exchange device from the above constraints, two water guide grooves 201, i.e., an upper water guide groove and a lower water guide groove, may be formed in the water guider 2, such that the first straight portion 101 may be located above the second straight portion 102, or the second straight portion 102 may be located above the first straight portion 101, when the user mounts the heat exchange device. Therefore, there is always one water guide groove 201 that opens upward in either above position, which is convenient for the user to use.

As shown in FIGS. 24 to 36, the width direction of the first side plate 211 is the left-right direction. A substantially middle part of the second side plate 212 in the up-down direction is connected to a right end of the first side plate 211. The fourth side plate 214 is connected to an upper end of the second side plate 212. The fifth side plate 215 is connected to a lower end of the second side plate 212. A substantially middle part of the third side plate 213 in the up-down direction is connected to a left end of the first side plate 211.

Further, the fourth side plate 214 and the fifth side plate 215 are symmetrically arranged with respect to the first side plate 211.

Figure 24:
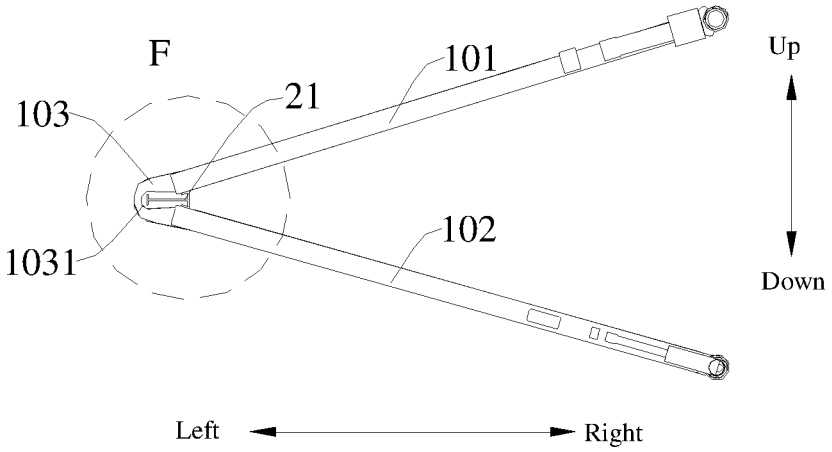
FIG. 24 is a side view of an eighth embodiment of the heat exchange device in FIG. 1.
Figure 25:
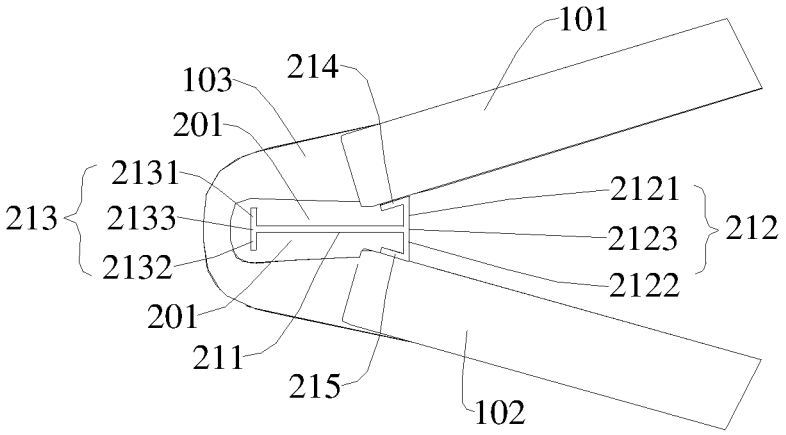
FIG. 25 is a partially enlarged view of part F in FIG. 24.
Figure 26:
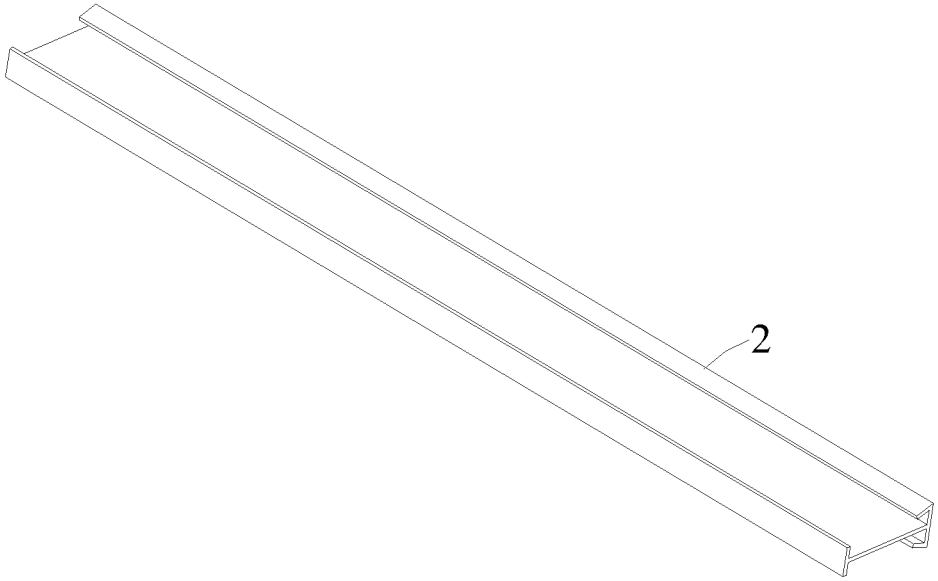
FIG. 26 is a schematic view of a body of a water guider in FIG. 24.

In some embodiments, as shown in FIGS. 24 to 26, the fourth side plate 214 extends leftward and is inclined downward from the upper end of the second side plate 212, and the fifth side plate 215 extends leftward and is inclined upward from the lower end of the second side plate 212. The third side plate 213 is located in the groove portion 1031. The second side plate 212, the fourth side plate 214 and the fifth side plate 215 are all located in the gap between the first straight portion 101 and the second straight portion 102. An entire upper surface of the fourth side plate 214 is in contact with the first straight portion 101, and an entire lower surface of the fifth side plate 215 is in contact with the second straight portion 102.

One water guide groove 201 is defined by a right surface of the first end section 2131 of the third side plate 213, an upper surface of the first side plate 211, a left surface of the first end section 2121 of the second side plate 212, and a lower surface of the fourth side plate 214, and the other water guide groove 201 is defined by a right surface of the second end section 2132 of the third side plate 213, a lower surface of the first side plate 211, a left surface of the second end section 2122 of the second side plate 212 and an upper surface of the fifth side plate 215.

In some embodiments, as shown in FIGS. 27 to 29 and 30 to 32, the fourth side plate 214 extends rightward and is inclined upward from the upper end of the second side plate 212, and the fifth side plate 215 extends rightward and is inclined downward from the lower end of the second side plate 212. The third side plate 213 is located in the groove portion 1031. The second side plate 212, the fourth side plate 214 and the fifth side plate 215 are all located in the gap between the first straight portion 101 and the second straight portion 102.

Figure 27:
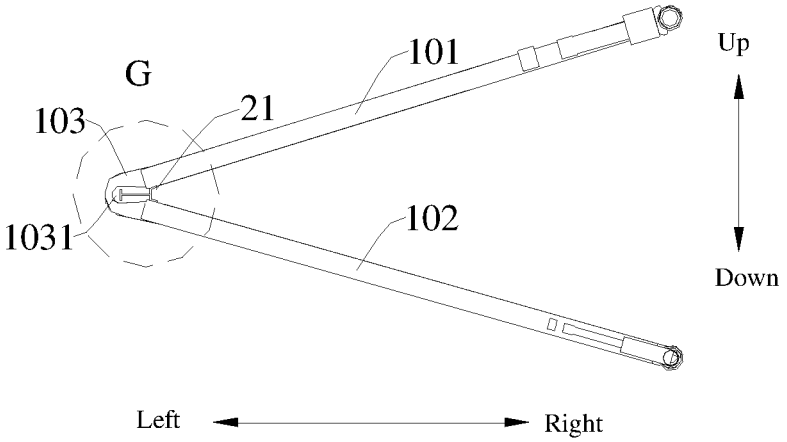
FIG. 27 is a side view of a ninth embodiment of the heat exchange device in FIG. 1.
Figure 28:
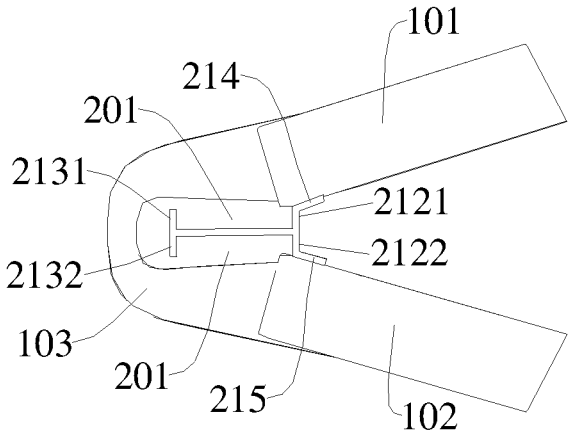
FIG. 28 is a partially enlarged view of part G in FIG. 27.
Figure 29:
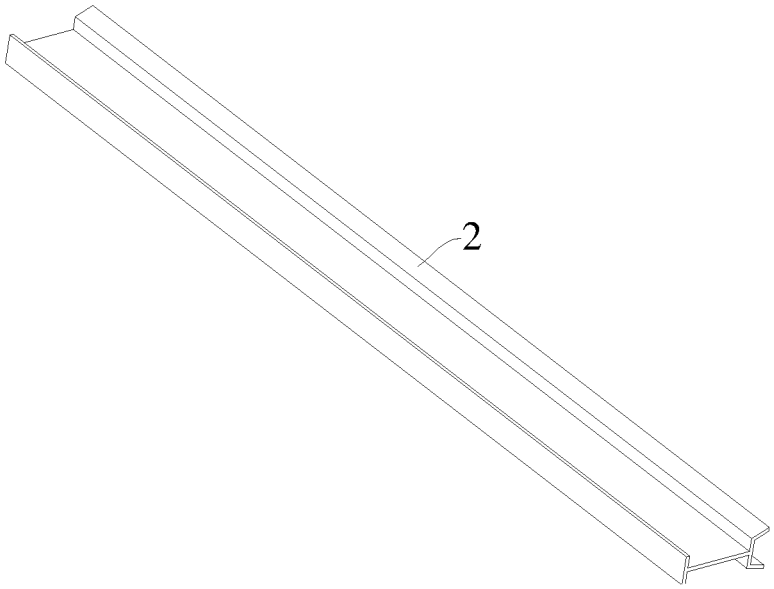
FIG. 29 is a schematic view of a body of a water guider in FIG. 27.

In the embodiments as shown in FIGS. 27 to 29, the entire upper surface of the fourth side plate 214 is in contact with the first straight portion 101, and the entire lower surface of the fifth side plate 215 is in contact with the second straight portion 102. One water guide groove 201 is defined by the right surface of the first end section 2131 of the third side plate 213, the upper surface of the first side plate 211 and the left surface of the first end section 2121 of the second side plate 212, and the other water guide groove 201 is defined by the right surface of the second end section 2132 of the third side plate 213, the lower surface of the first side plate 211, and the left surface of the second end section 2122 of the second side plate 212.

Figure 30:
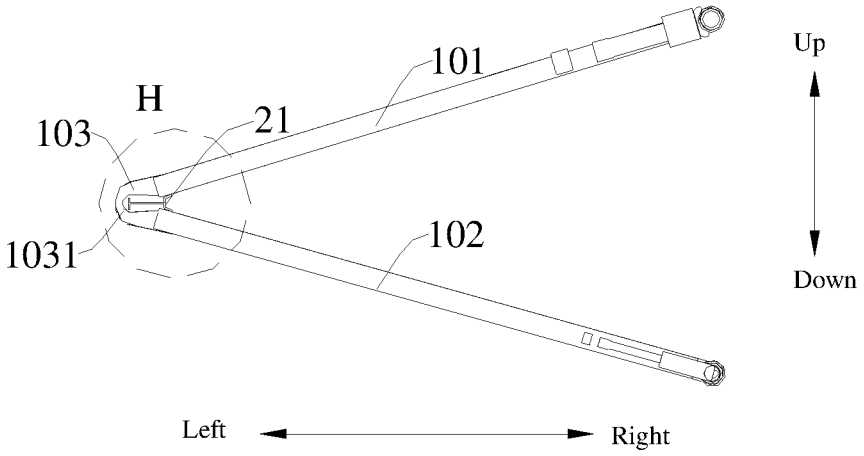
FIG. 30 is a side view of a tenth embodiment of the heat exchange device in FIG. 1.
Figure 31:
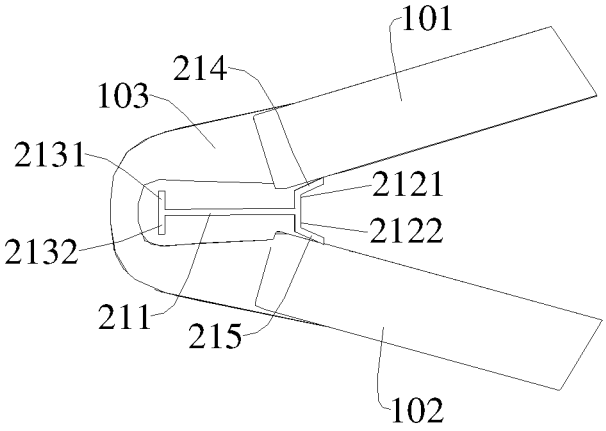
FIG. 31 is a partially enlarged view of part H in FIG. 30.
Figure 32:
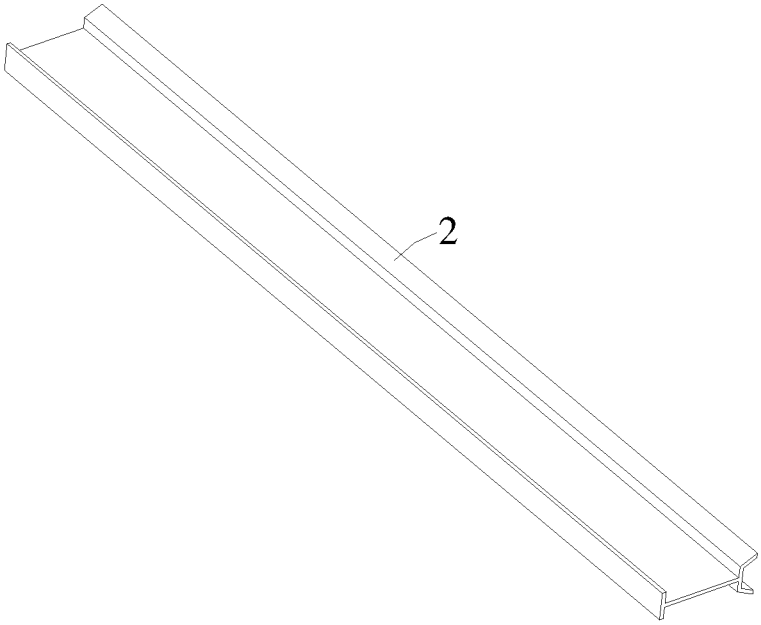
FIG. 32 is a schematic view of a body of a water guider in FIG. 30.

In the embodiments shown in FIGS. 30 to 32, a part of the upper surface of the fourth side plate 214 is in contact with the first straight portion 101, and a part of the lower surface of the fifth side plate 215 is in contact with the second straight portion 102. One water guide groove 201 is defined by the right surface of the first end section 2131 of the third side plate 213, the upper surface of the first side plate 211, the left surface of the first end section 2121 of the second side plate 212, and the upper surface of the fourth side plate 214, and the other water guide groove 201 is defined by the right surface of the second end section 2132 of the third side plate 213, the lower surface of the first side plate 211, the left surface of the second end section 2122 of the second side plate 212 and the lower surface of the fifth side plate 215.

Specifically, an edge is provided between the upper surface of the fourth side plate 214 and a right surface of the fourth side plate 214, and the edge is in contact with the first straight portion 101. An edge is provided between the lower surface of the fifth side plate 215 and a right surface of the fifth side plate 215, and the edge is in contact with the second straight portion 102.

In some specific embodiments, the fourth side plate 214 includes a first plate section 2141 and a second plate section 2142, one end of the first plate section 2141 is connected to the first end section 2121 of the second side plate 212, the other end of the first plate section 2141 is connected to one end of the second plate section 2142, and an end face of the other end of the second plate section 2142 is in contact with the first straight portion 101.

The fifth side plate 215 includes a first plate portion 2151 and a second plate portion 2152, one end of the first plate portion 2151 is connected to the second end section 2122 of the second side plate 212, the other end of the first plate portion 2151 is connected to one end of the second plate portion 2152, and an end face of the other end of the second plate portion 2152 is in contact with the second straight portion 102.

Figure 33:
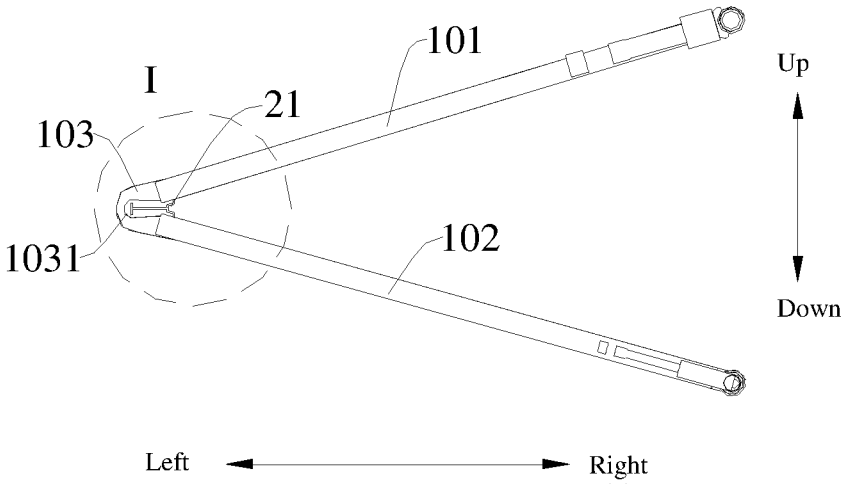
FIG. 33 is a side view of an eleventh embodiment of the heat exchange device in FIG. 1.
Figure 34:
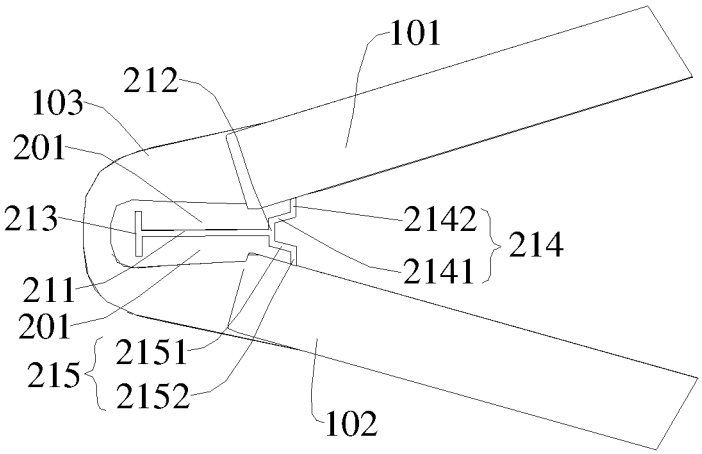
FIG. 34 is a partially enlarged view of part I in FIG. 33.
Figure 35:
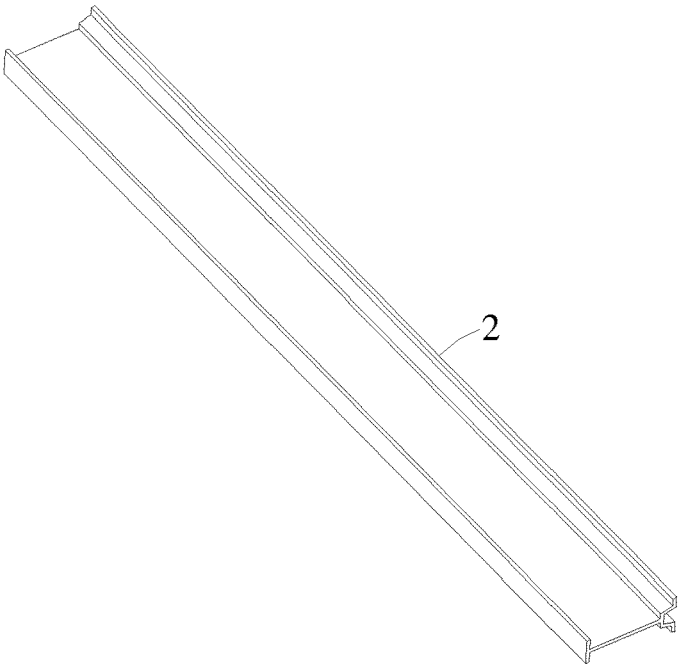
FIG. 35 is a schematic view of a body of a water guider in FIG. 33.
Figure 36:
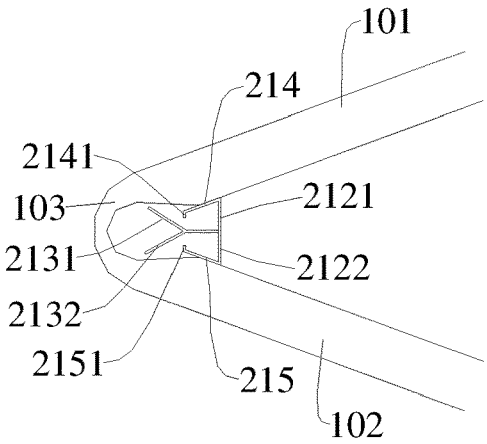
FIG. 36 is a partial schematic view of a twelfth embodiment of the heat exchange device in FIG. 1.

As shown in FIGS. 33 to 35, the first plate section 2141 of the fourth side plate 214 extends rightward and is inclined upward from an upper end of the first end section 2121 of the second side plate 212, and the second plate section 2142 of the fourth side plate 214 extends upward from a right end of the first plate section 2141 to be in contact with the first straight portion 101.

The first plate portion 2151 of the fifth side plate 215 extends rightward and is inclined downward from a lower end of the second end section 2122 of the second side plate 212, and the second plate portion 2152 of the fifth side plate 215 extends downward from a right end of the first plate portion 2151 to be in contact with the second straight portion 102.

As shown in FIGS. 24 to 35, both the third side plate 213 and the second side plate 212 extend in the up-down direction. However, the present disclosure is not limited to this. For example, in an embodiment shown in FIG. 36, the first end section 2131 of the third side plate 213 is inclined downward in the direction from left to right, and the second end section 2132 of the third side plate 213 is inclined upward in the direction from left to right.

Further, the first end section 2131 and the second end section 2132 of the third side plate 213 are symmetrically arranged with respect to the first side plate 211. The fourth side plate 214 extends leftward and is inclined downward from the upper end of the second side plate 212, and the fifth side plate 215 extends leftward and is inclined upward from the lower end of the second side plate 212.

A part of the upper surface of the fourth side plate 214 is in contact with the first straight portion 101, and a part of the lower surface of the fifth side plate 215 is in contact with the second straight portion 102.

Specifically, a left side part of the fourth side plate 214 and a left side part of the fifth side plate 215 are located in the groove portion 1031, the upper surface of a right side part of the fourth side plate 214 is in contact with the first straight portion 101, and the lower surface of a right side part of the fifth side plate 215 is in contact with the second straight portion 102. The fourth side plate 214 has a first bent part at its left end, and the first bent part is arranged opposite to the first end section 2121 of the second side plate 212. The fifth side plate 215 has a second bent part at its left end, and the second bent part is arranged opposite to the second end section 2122 of the second side plate 212.

In some embodiments, as shown in FIGS. 24 to 36, the second side plate 212 is located in the gap between the first straight portion 101 and the second straight portion 102. It can be understood that the present disclosure is not limited to this. For example, in an embodiment shown in FIG. 37, the second side plate 212 and the third side plate 213 are both located in the groove portion 1031.

Figure 37:
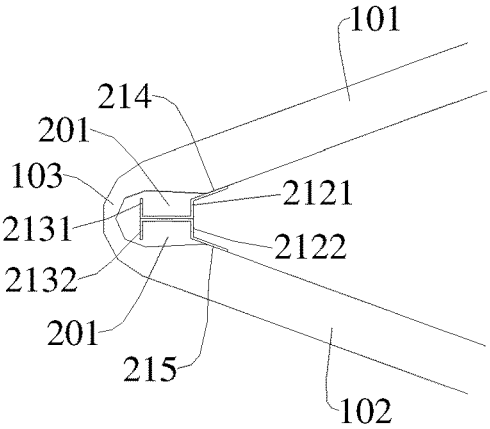
FIG. 37 is a partial schematic view of a thirteenth embodiment of the heat exchange device in FIG. 1.

In the embodiment as shown in FIG. 37, the fourth side plate 214 extends rightward and is inclined upward from the upper end of the first end section 2121 of the second side plate 212, the left side part of the fourth side plate 214 is located in the groove portion 1031, and the upper surface of the right side part of the fourth side plate 214 is in contact with the first straight portion 101. The fifth side plate 215 extends rightward and is inclined downward from the lower end of the second end section 2122 of the second side plate 212, the left side part of the fifth side plate 215 is located in the groove portion 1031, and the lower surface of the right side part of the fifth side plate 215 is in contact with the second straight portion 102.

Figure 38:
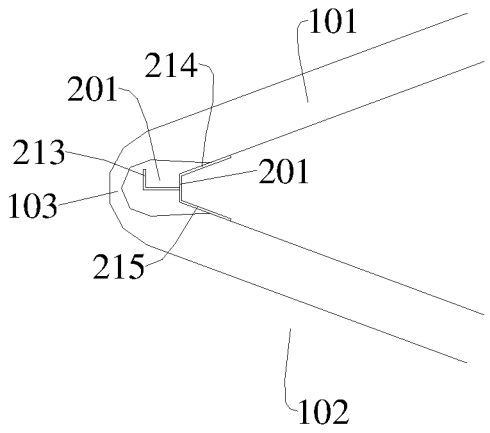
FIG. 38 is a partial schematic view of a fourteenth embodiment of the heat exchange device in in FIG. 1.

It can be understood that the third side plate 213 of the present disclosure may not be configured in the form of the third side plate 213 shown in FIGS. 24 to 37, while the second side plate 212 is configured in the form of the second side plate 212 shown in FIGS. 24 to 37. As shown in FIG. 38, the lower end of the third side plate 213 is connected to the left end of the first side plate 211, and the connecting portion of the second side plate 212 is connected to the right end of the first side plate 211.

Further, in the embodiment as shown in FIG. 38, the first side plate 211, the second side plate 212 and the third side plate 213 are all arranged in the groove portion 1031. The fourth side plate 214 extends rightward and is inclined upward from the upper end of the first end section 2121 of the second side plate 212, the left side part of the fourth side plate 214 is located in the groove portion 1031, and the upper surface of the right side part of the fourth side plate 214 is in contact with the first straight portion 101. The fifth side plate 215 extends rightward and is inclined downward from the lower end of the second end section 2122 of the second side plate 212, the left side part of the fifth side plate 215 is located in the groove portion 1031, and the lower surface of the right side part of the fifth side plate 215 is in contact with the second straight portion 102.

As shown in FIGS. 24 to 38, the fourth side plate 214 is in direct contact with the first straight portion 101, and the fifth side plate 214 is in direct contact with the second straight portion 102. It can be understood that the present disclosure is not limited to this.

Figure 39:
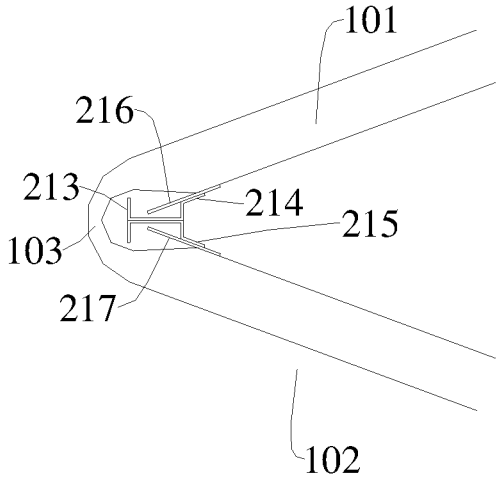
FIG. 39 is a partial schematic view of a fifteenth embodiment of the heat exchange device in FIG. 1.

As shown in FIG. 39, a sixth side plate 216 is provided between the fourth side plate 214 and the first straight portion 101. Two opposite surfaces of the sixth side plate 216 are in contact with the first straight portion 101 and the fourth side plate 214, respectively, that is, the fourth side plate 214 is in indirect contact with the first straight portion 101. A seventh side plate 217 is provided between the fifth side plate 215 and the second straight portion 102. Two opposite surfaces of the seventh side plate 217 are in contact with the fifth side plate 215 and the second straight portion 102, respectively, that is, the fifth side plate 215 is in indirect contact with the second straight portion 102.

Further, the second side plate 212 and the third side plate 213 are both located in the groove portion 1031, the fourth side plate 214 extends rightward and is inclined upward from the upper end of the first end section 2121 of the second side plate 212, and the fifth side plate 215 extends rightward and is inclined downward from the lower end of the second end section 2122 of the second side plate 212.

The sixth side plate 216 extends in the direction from left to right and is inclined upward, the sixth side plate 216 is arranged parallel to the fourth side plate 214, and the entire upper surface of the fourth side plate 214 is in contact with a lower surface of the sixth side plate 216. A left side part of the sixth side plate 216 is located in the groove portion 1031, and an upper surface of a right side part of the sixth side plate 216 is in contact with the first straight portion 101. A left end of the sixth side plate 216 is spaced apart from the upper surface of the first side plate 211 and the right surface of the first end section 2131 of the third side plate 213, and a position of the left end of the sixth side plate 216 is lower than a position of an upper end of the first end section 2131 of the third side plate 213.

The seventh side plate 217 extends in the direction from left to right and is inclined downward, the seventh side plate 217 is arranged parallel to the fifth side plate 215, and the entire upper surface of the fifth side plate 215 is in contact with an upper surface of the seventh side plate 217. A left side part of the seventh side plate 217 is located in the groove portion 1031, and a lower surface of a right side part of the seventh side plate 217 is in contact with the second straight portion 102. A left end of the seventh side plate 217 is spaced apart from the lower surface of the first side plate 211 and the right surface of the second end section 2132 of the third side plate 213, and a position of the left end of the seventh side plate 217 is higher than a position of a lower end of the second end section 2132 of the third side plate 213.

In the embodiments as shown in FIGS. 4 to 6 and 10 to 39, the body 21 is formed integrally.

Figure 40:
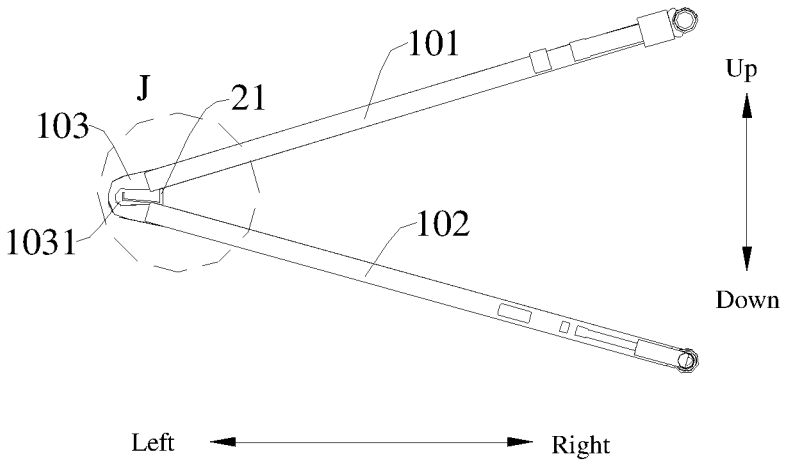
FIG. 40 is a side view of a sixteenth embodiment of the heat exchange device in FIG. 1.
Figure 41:
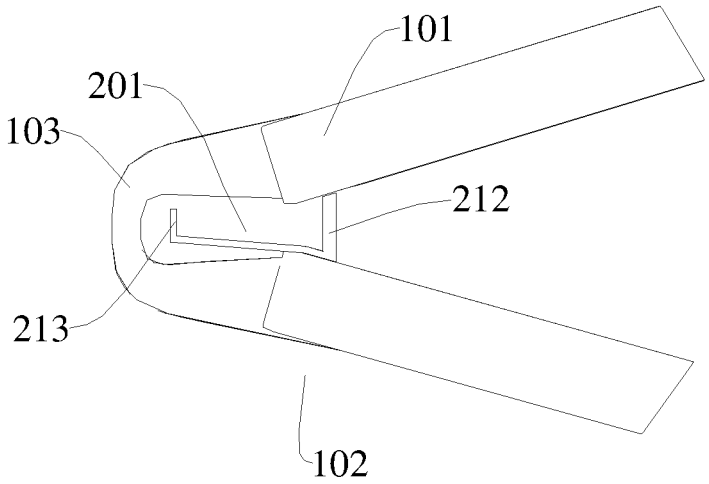
FIG. 41 is a partially enlarged view of part J in FIG. 40.
Figure 42:
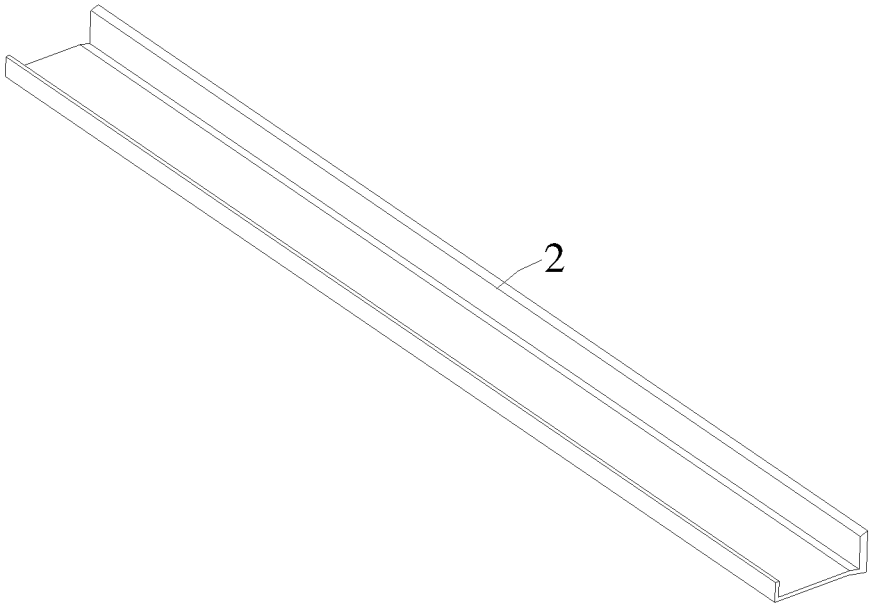
FIG. 42 is a schematic view of a body of a water guider in FIG. 40.

In still other embodiments, as shown in FIGS. 40 to 42, the body 21 includes a first side plate 211, a second side plate 212 and a third side plate 213. The first side plate 211 includes a first end and a second end in its width direction, and at least a part of the first side plate 211 is in contact with one of the first straight portion 101 and the second straight portion 102.

One end of the second side plate 212 is connected to the first end of the first side plate 211, and the other end of the second side plate 212 is in contact with the other one of the first straight portion 101 and the second straight portion 102. The second side plate 212 is located in the gap between the first straight portion 101 and the second straight portion 102.

One end of the third side plate 213 is connected to the second end of the first side plate 211, the other end of the third side plate 213 is a free end, the third side plate 213 and the second side plate 212 are arranged opposite to each other in the width direction of the first side plate 211, and the third side plate 213 is located in the groove portion 1031.

The water guide groove 201 is defined by the third side plate 213, the first side plate 211 and the second side plate 212.

In the embodiments as shown in FIGS. 40 to 42, the width direction of the first side plate 211 is the left-right direction. The first side plate 211 includes a first section 2111 and a second section 2112 that are sequentially connected from left to right. The first section 2111 of the first side plate 211 is inclined downward in the direction from left to right, the second section 2112 of the first side plate 211 is inclined downward in the direction from left to right, and an inclination angle of the second section 2112 is greater than that of the first section 2111. The third side plate 213 and a large left side part of the first section 2111 of the first side plate 211 are located in the groove portion 1031. A small right side part of the first section 2111 of the first side plate 211 and the second side plate 212 are located in the gap between the first straight portion 101 and the second straight portion 102.

An entire lower surface of the second section 2112 is in contact with the second straight portion 102, and the juncture between the second straight portion 102 and the bent portion 103 is in contact with the first section 2111. An upper end face of the second side plate 212 is in contact with the first straight portion 101.

In some embodiments, a thickness of the second side plate 212 is greater than that of the third side plate 213. As shown in FIGS. 40 to 42, a dimension of the second side plate 212 in the left-right direction is larger than that of the third side plate 213 in the left-right direction. By increasing the thickness of the second side plate 212, a contact area between the second side plate 212 and the first straight portion 101 can be increased, such that the mounting stability can be improved.

Further, the thickness of the third side plate 213 is identical with a thickness of the first side plate 211. As shown in FIGS. 40 to 42, the dimension of the third side plate 213 in the left-right direction is the same with that of the first side plate 211 in the up-down direction. Specifically, the first side plate 211 and the third side plate 213 are integrally formed.

Figure 43:
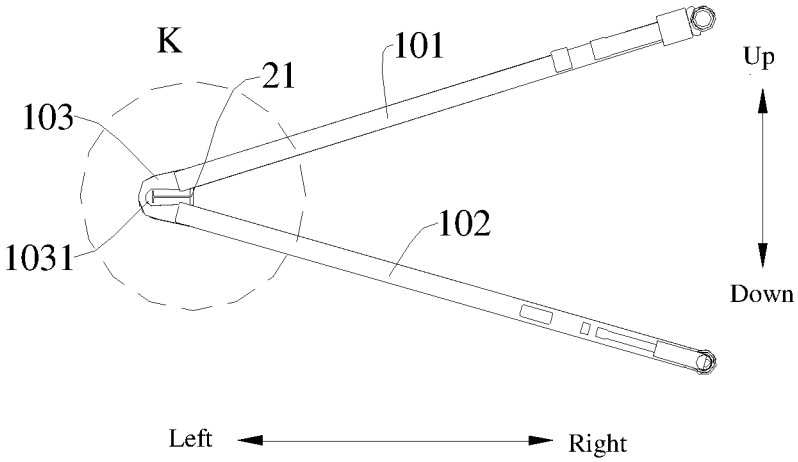
FIG. 43 is a side view of a seventeenth embodiment of the heat exchange device in FIG. 1.
Figure 44:
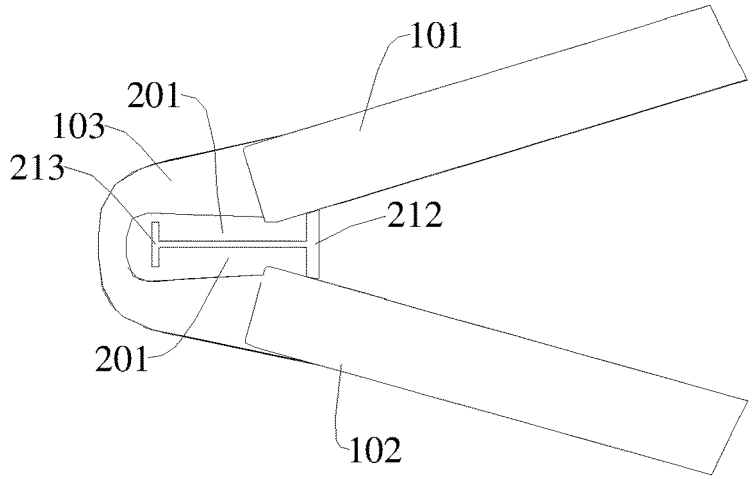
FIG. 44 is a partially enlarged view of part K in FIG. 43.
Figure 45:
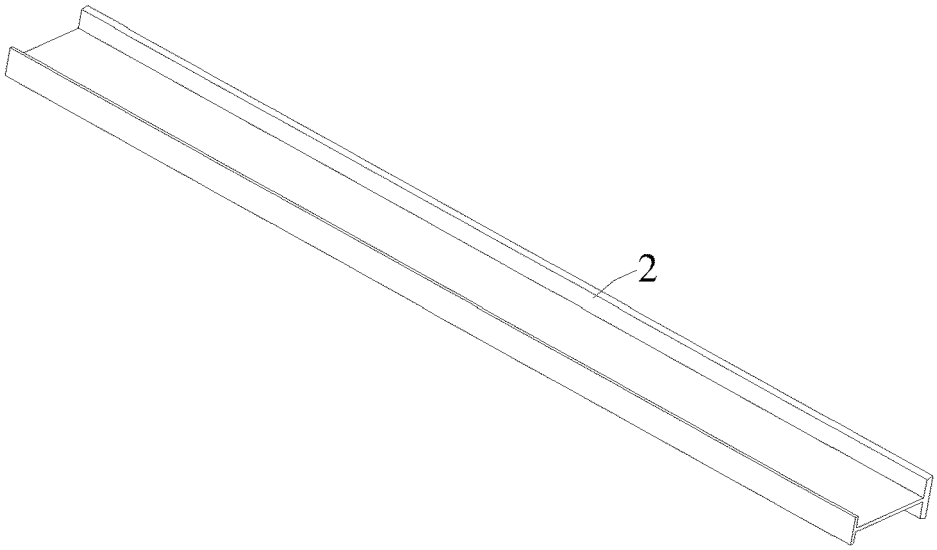
FIG. 45 is a schematic view of a body of a water guider in FIG. 43.

In still other embodiments, as shown in FIGS. 43 to 45, the body 21 includes a first side plate 211, a second side plate 212 and a third side plate 213. The first side plate 211 includes a first end and a second end in its width direction.

The second side plate 212 includes a first end section 2121, a second end section 2122, and a connecting portion 2123 connected between the first end section 2121 and the second end section 2122 of the second side plate 212. The connecting portion 2123 of the second side plate 212 is connected to the first end of the first side plate 211. An upper end face of the first end section 2121 of the second side plate 212 is in contact with the first straight portion 101, and a lower end face of the second end section 2122 of the second side plate 212 is in contact with the second straight portion 102.

The third side plate 213 includes a first end section 2131, a second end section 2132, and a connecting portion 2133 connected between the first end section 2131 and the second end section 2132 of the third side plate 213. The connecting portion 2133 of the third side plate 213 is connected to the second end of the first side plate 211, and the third side plate 213 is located in the groove portion 1031.

As shown in FIGS. 43 to 45, the width direction of the first side plate 211 is the left-right direction. A substantially middle part of the second side plate 212 in the up-down direction is connected to a right end of the first side plate 211. The upper end face of the second side plate 212 is in contact with the first straight portion 101, and the lower end face of the second side plate 212 is in contact with the second straight portion 102. A substantially middle part of the third side plate 213 in the up-down direction is connected to a left end of the first side plate 211.

Further, a thickness of the second side plate 212 is greater than that of the third side plate 213. As shown in FIGS. 43 to 45, a dimension of the second side plate 212 in the left-right direction is larger than that of the third side plate 213 in the left-right direction. By increasing the thickness of the second side plate 212, a contact area between the second side plate 212 and the first straight portion 101 and a contact area between the second side plate 212 and the second straight portion 101 can be increased, such that the mounting stability can be improved.

Further, the thickness of the third side plate 213 is identical with a thickness of the first side plate 211. As shown in FIGS. 43 to 45, the dimension of the third side plate 213 in the left-right direction is the same with that of the first side plate 211 in the up-down direction. Specifically, the first side plate 211 and the third side plate 213 are integrally formed.

In still other embodiments, the body 21 has an arc-shaped cross section. The opening of the water guide groove 201 is located in the groove portion 1031. The juncture between the first straight portion 101 and the bent portion 103 is in contact with an outer peripheral surface of the body 21. The juncture between the second straight portion 102 and the bent portion 103 is in contact with the outer peripheral surface of the body 21.

Figure 46:
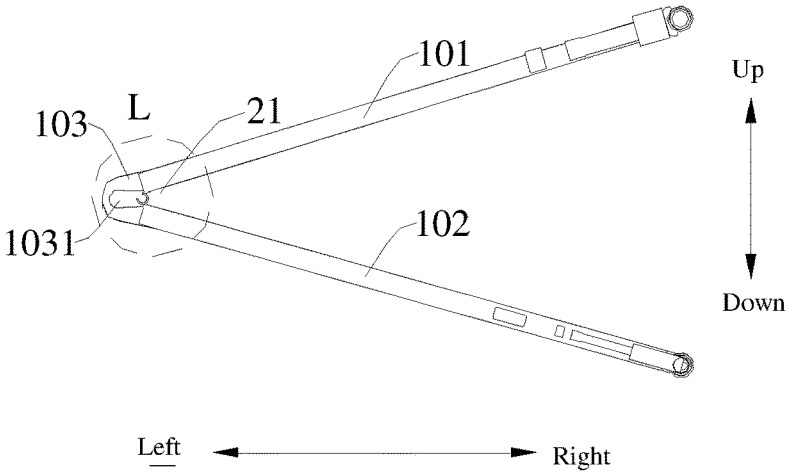
FIG. 46 is a side view of an eighteenth embodiment of the heat exchange device in FIG. 1.
Figure 47:
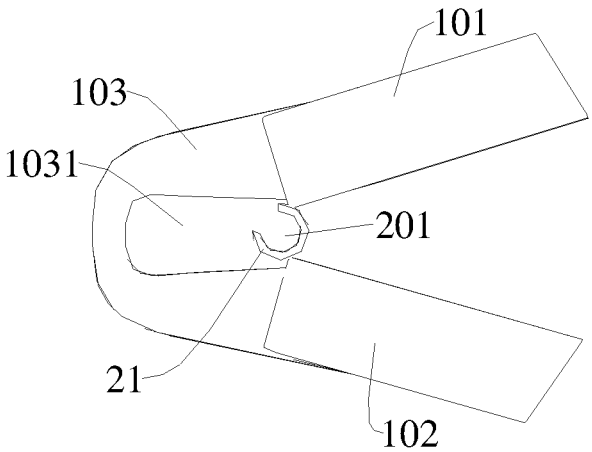
FIG. 47 is a partially enlarged view of part L in FIG. 46.
Figure 48:
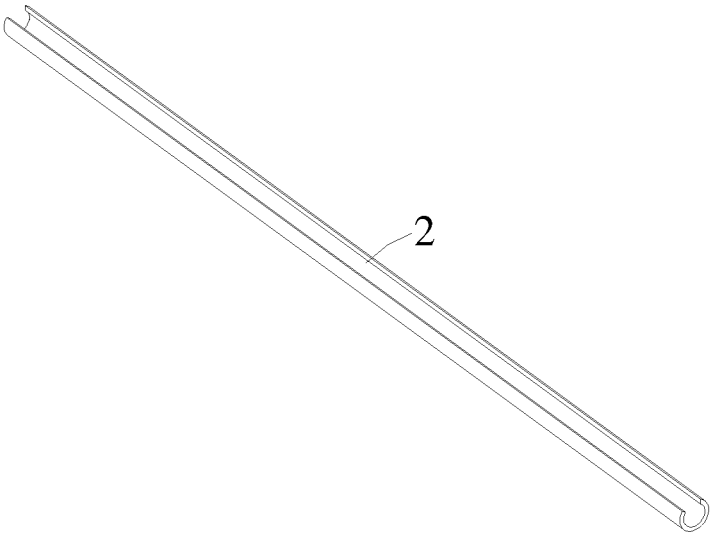
FIG. 48 is a schematic view of a body of a water guider in FIG. 46.
Figure 49:
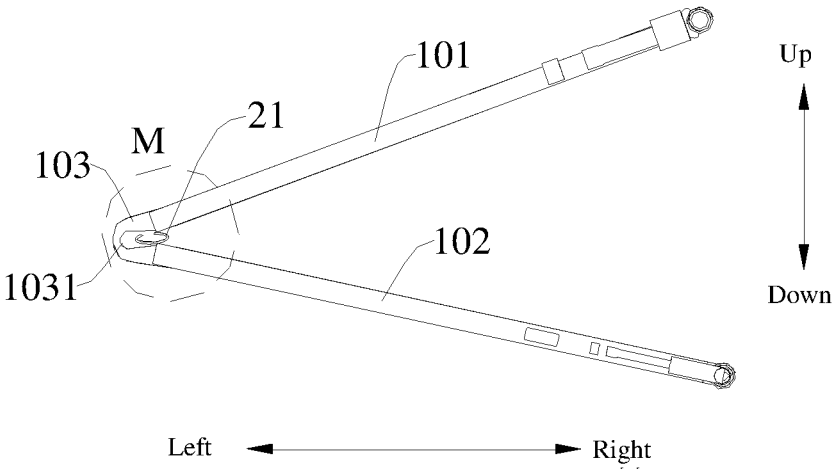
FIG. 49 is a side view of a nineteenth embodiment of the heat exchange device in FIG. 1.
Figure 50:
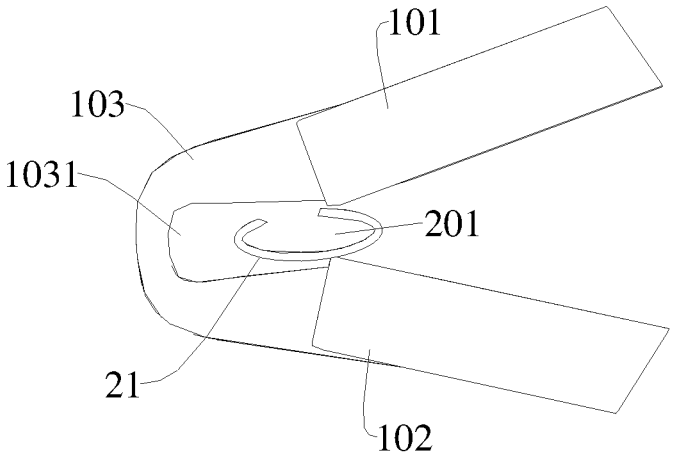
FIG. 50 is a partially enlarged view of part L in FIG. 49.
Figure 51:
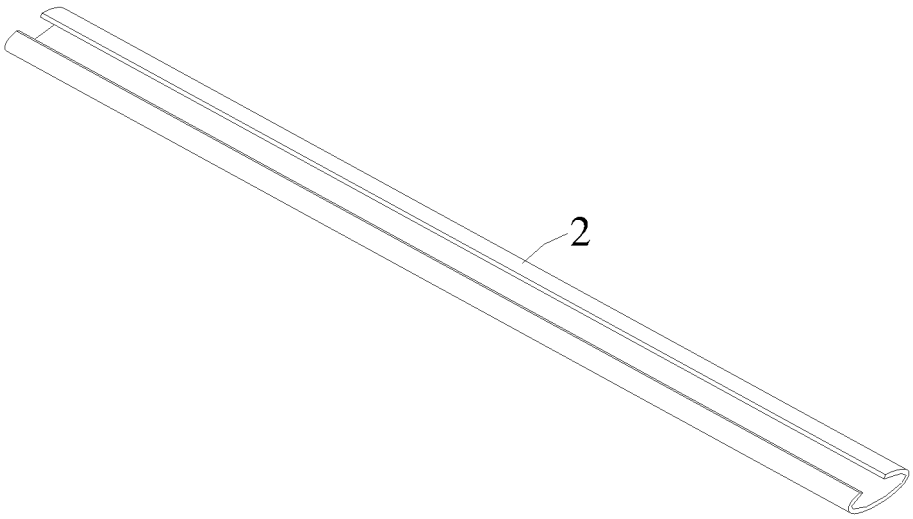
FIG. 51 is a schematic view of a body of a water guider in FIG. 49.

As shown in FIGS. 46 to 48, the body 21 is substantially a circular tube, that is, a cross section of the body 21 is substantially circular. As shown in FIGS. 49 to 51, the body 21 is substantially an elliptical tube, that is, a cross section of the body 21 is substantially elliptical. In addition, a tube wall of the circular tube or the elliptical tube is provided with an opening that extends in an axial direction of the tube, such that a space enclosed by an inner peripheral surface of the tube forms the water guide groove 201. Moreover, this opening is the opening of the water guide groove 201, and is located in the groove portion 1031. An upper side of an outer surface of the tube wall of the tube is in contact with the juncture between the first straight portion 101 and the bent portion 103, and a lower side of the outer surface of the tube wall of the tube is in contact with the juncture between the second straight portion 102 and the bent portion 103. As shown in FIGS. 49 to 51, the opening of the water guide groove 201 faces upward, such that the condensed water on the first straight portion 101 enters the water guide groove 201 through this opening, and is guided out by the water guide groove 201 into the water receiving tray 3.

Figure 52:
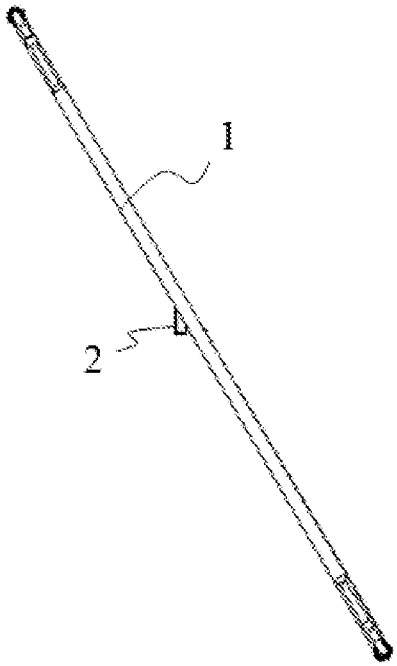
FIG. 52 is a side view of a heat exchange device according to another embodiment of the present disclosure.
Figure 53:
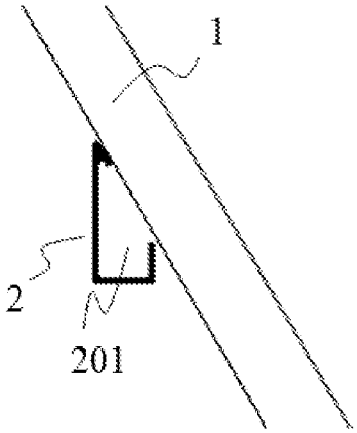
FIG. 53 is a partially enlarged view of the heat exchange device in FIG. 52.

It can be understood that the present disclosure is not limited to the above bent heat exchanger. The heat exchanger 1 in the heat exchange device of the present disclosure may also be the flat plate heat exchanger, as shown in FIGS. 52 to 53.

For a large flat plate heat exchanger, the condensed water on the large flat plate heat exchanger gradually flows from a top of the large flat plate heat exchanger to a bottom of the large flat plate heat exchanger generally depending on the gravity when in use, and finally flows to the water receiving tray. However, since the height of the large flat plate heat exchanger usually exceeds 800 mm, a drainage amount of a single fin is very large, resulting in a large amount of condensed water on the fins at a lower portion of the large flat plate heat exchanger. The condensed water blocks fin windows and gaps between the fins, thereby reducing the effective heat exchange area of the large flat plate heat exchanger, increasing the wind resistance, and reducing the heat exchange efficiency of the heat exchanger.

Therefore, the water guider 2 is arranged on the large flat plate heat exchanger. The condensed water on a part of the heat exchanger 1 is guided out through the water guider 2, so as to avoid a large amount of condensed water on the fins at the lower portion of the large flat plate heat exchanger, thereby increasing the effective heat exchange area of the large flat plate heat exchanger, reducing the wind resistance, and improving the heat exchange efficiency of the heat exchanger.

In some embodiments, the water guider 2 is arranged at a substantially middle position of the flat plate heat exchanger in a height direction, such that the condensed water on an upper half part of the flat plate heat exchanger can be guided into the water receiving tray 3 through the water guider 2.

In some embodiments, the outer surface of the water guider 2 is provided with a flexible material, such as a rubber plastic, or a polyester board. By arranging the flexible material on the outer surface of the water guider 2, it is convenient to mount the water guider 2, so as to avoid damages of the water guider 2 and the heat exchanger 1 caused by the direct contact between the water guider 2 and the heat exchanger 1. In addition, since the contact joint between the water guider 2 and the heat exchanger 1 is prone to corrosion under the action of the condensed water for a long time, by providing the flexible material, the contact joint between the water guider 2 and the heat exchanger 1 can also be prevented from being corroded.

In some embodiments, the outer surface of the water guider 2 is covered with a heat preservation material, which is used for heat insulation, so as to prevent condensed water from being generated on the outer surface of the water guider 2.

In the present disclosure, terms such as "an embodiment," "some embodiments," "an example," "a specific example," or "some examples," means that a particular feature, structure, material, or characteristic described in connection with the embodiment or example is included in at least one embodiment or example of the present disclosure. Thus, the appearances of these terms in various places throughout this specification are not necessarily referring to the same embodiment or example of the present disclosure. Furthermore, the particular features, structures, materials, or characteristics may be combined in any suitable manner in one or more embodiments or examples. In addition, without contradiction, those skilled in the art may combine and unite different embodiments or examples or features of the different embodiments or examples described in this specification.

In the present disclosure, unless otherwise explicitly specified and defined, the terms "mounted," "interconnected," "connected," "fixed" and the like are used broadly, and may be, for example, fixed connections, detachable connections, or integral connections; may also be mechanical or electrical connections or intercommunication; may also be direct connections or indirect connections via intervening structures; may also be inner communications or interactions of two elements, which can be understood by those skilled in the art according to specific situations.

In the present disclosure, unless otherwise explicitly specified and defined, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Although the embodiments of the present disclosure have been shown and described above, it can be understood that the above embodiments are exemplary and shall not be understood as limitation to the present disclosure, and changes, modifications, alternatives and variations can be made in the above embodiments within the scope of the present disclosure.

What is claimed is:

1. A heat exchange device, comprising:

a heat exchanger comprising:

a first header and a second header arranged in a direction;

a plurality of flat tubes, each flat tube comprising a first straight section, a second straight section and a bent section, wherein an end of the first straight section of each flat tube is connected to the first header, another end of the first straight section of each flat tube is connected to an end of the bent section of each flat tube, another end of the bent section of each flat tube is connected to an end of the second straight section of each flat tube, another end of the second straight section of each flat tube is connected to the second header, a predetermined included angle is formed between a length direction of the first straight section of each flat tube and a length direction of the second straight section of each flat tube, and the first straight section of each flat tube and the second straight section of each flat tube define a gap therebetween in the direction in which the first header and the second header are arranged; and fins arranged between the first straight sections of adjacent flat tubes of the plurality of flat tubes and between the second straight sections of adjacent flat tubes of the plurality of flat tubes, respectively, wherein the heat exchanger comprises a first straight portion, a second straight portion and a bent portion, wherein the first straight portion comprises the first straight sections of the plurality of flat tubes and the fins arranged between the first straight sections of adjacent flat tubes of the plurality of flat tubes, the second straight portion comprises the second straight sections of the plurality of flat tubes and the fins arranged between the second straight sections of adjacent flat tubes of the plurality of flat tubes, the bent portion comprises the bent sections of the plurality of flat tubes, and the bent portion encloses a groove portion that opens toward a gap between the first straight portion and the second straight portion; and a water guider having a first end and a second end, the first end of the water guider being arranged between the first straight portion and the second straight portion and in contact with the first straight portion and the second straight portion respectively, the second end of the water guider extending to the groove portion, a length direction of the water guider being substantially parallel to a width direction of the heat exchanger, the water guider having a water guide groove, a length direction of the water guide groove being substantially parallel to the length direction of the water guider, the water guide groove allowing condensed water on at least a part of the heat exchanger to flow out therethrough, wherein the water guider comprises a body, a first end plate and a second end plate, wherein the water guide groove penetrates through the body along a length direction of the body, the body has a first end and a second end in the length direction thereof, the first end plate is arranged at the first end of the body, the second end plate is arranged at the second end of the body, and at least one of the first end plate and the second end plate is provided with a port communicated with the water guide groove, wherein the body comprises:

a first side plate comprising a first end and a second end in a width direction thereof, at least a part of the first side plate being in contact with one of the first straight portion and the second straight portion;

a second side plate, an end of the second side plate being connected to the first end of the first side plate, and the second side plate being located in the gap between the first straight portion and the second straight portion;

a third side plate, an end of the third side plate being connected to the second end of the first side plate, another end of the third side plate being a free end, the third side plate and the second side plate being arranged opposite to each other in the width direction of the first side plate, and the third side plate being located in the groove portion; and a fourth side plate arranged at another end of the second side plate, at least a part of the fourth side plate being in contact with the other one of the first straight portion and the second straight portion, wherein the water guide groove is defined by the third side plate, the first side plate, the second side and the fourth side plate.

2. The heat exchange device according to claim 1, wherein the first side plate comprises a first section and a second section, an end of the first section is connected to the third side plate, the first section is inclined toward the one of the first straight portion and the second straight portion in a direction from the third side plate to the second side plate, the second section is inclined from another end of the first section toward the one of the first straight portion and the second straight portion in the direction from the third side plate to the second side plate, an inclination angle of the second section is greater than an inclination angle of the first section, and at least a part of the second section is in contact with the one of the first straight portion and the second straight portion.

3. The heat exchange device according to claim 2, wherein a surface of the second section away from the fourth side plate is in contact with the one of the first straight portion and the second straight portion, and the second side plate is arranged at an end of the second section away from the first section.

4. The heat exchange device according to claim 1, wherein the first side plate is a straight plate inclined toward the one of the first straight portion and the second straight portion in a direction from the third side plate to the second side plate, and the one of the first straight portion and the second straight portion is in contact with a part of the first side plate adjacent to the first end of the first side plate.

5. The heat exchange device according to claim 4, wherein the body further comprises a fifth side plate extending from an end of the fourth side plate away from the second side plate, and the fifth side plate and the third side plate are spaced apart in the width direction of the first side plate, the water guide groove is defined by the third side plate, the first side plate, the second side plate, the fourth side plate and the fifth side plate.

6. The heat exchange device according to claim 1, wherein a surface of the fourth side plate away from the first side plate is in contact with the other one of the first straight portion and the second straight portion.

7. A heat exchange device, comprising:

a heat exchanger comprising:

a first header and a second header arranged in a direction;

a plurality of flat tubes, each flat tube comprising a first straight section, a second straight section and a bent section, wherein an end of the first straight section of each flat tube is connected to the first header, another end of the first straight section of each flat tube is connected to an end of the bent section of each flat tube, another end of the bent section of each flat tube is connected to an end of the second straight section of each flat tube, another end of the second straight section of each flat tube is connected to the second header, a predetermined included angle is formed between a length direction of the first straight section of each flat tube and a length direction of the second straight section of each flat tube, and the first straight section of each flat tube and the second straight section of each flat tube define a gap therebetween in the direction in which the first header and the second header are arranged; and fins arranged between the first straight sections of adjacent flat tubes of the plurality of flat tubes and between the second straight sections of adjacent flat tubes of the plurality of flat tubes, respectively, wherein the heat exchanger comprises a first straight portion, a second straight portion and a bent portion, wherein the first straight portion comprises the first straight sections of the plurality of flat tubes and the fins arranged between the first straight sections of adjacent flat tubes of the plurality of flat tubes, the second straight portion comprises the second straight sections of the plurality of flat tubes and the fins arranged between the second straight sections of adjacent flat tubes of the plurality of flat tubes, the bent portion comprises the bent sections of the plurality of flat tubes, and the bent portion encloses a groove portion that opens toward a gap between the first straight portion and the second straight portion; and a water guider having a first end and a second end, the first end of the water guider being arranged between the first straight portion and the second straight portion and in contact with the first straight portion and the second straight portion respectively, the second end of the water guider extending to the groove portion, a length direction of the water guider being substantially parallel to a width direction of the heat exchanger, the water guider having a first water guide groove, a length direction of the first water guide groove being substantially parallel to the length direction of the water guider, the first water guide groove allowing condensed water on at least a part of the heat exchanger to flow out therethrough, wherein the water guider comprises a body, a first end plate and a second end plate, wherein the first water guide groove penetrates through the body along a length direction of the body, the body has a first end and a second end in the length direction thereof, the first end plate is arranged at the first end of the body, the second end plate is arranged at the second end of the body, and at least one of the first end plate and the second end plate is provided with a port communicated with the first water guide groove, wherein the body comprises:

a first side plate comprising a first end and a second end in a width direction thereof;

a second side plate comprising a first end section, a second end section, and a connecting portion connected between the first end section and the second end section of the second side plate, the connecting portion of the second side plate being connected to the first end of the first side plate, and the second side plate being located in the gap between the first straight portion and the second straight portion;

a third side plate comprising a first end section, a second end section, and a connecting portion connected between the first end section and the second end section of the third side plate, the connecting portion of the third side plate being connected to the second end of the first side plate, and the third side plate being located in the groove portion;

a fourth side plate connected to the first end section of the second side plate, at least a part of the fourth side plate being in contact with the other one of the first straight portion and the second straight portion; and a fifth side plate connected to the second end section of the second side plate, at least a part of the fifth side plate being in contact with one of the first straight portion and the second straight portion.

8. The heat exchange device according to claim 7, wherein a surface of the fourth side plate away from the second side plate is in contact with the one of the first straight portion and the second straight portion, and a surface of the fifth side plate away from the second side plate is in contact with the other one of the first straight portion and the second straight portion.

9. The heat exchange device according to claim 8, wherein the fourth side plate extends from a first end of the second side plate in a direction of the third side plate, and the fifth side plate extends from a second end of the second side plate in the direction of the third side plate, and wherein the water guider further comprises a second water guide groove, wherein one of the first and water guide grooves is defined by the first end section of the third side plate, the first side plate, the first end section of the second side plate and the fourth side plate, and the other of the first and second water guide grooves is defined by the second end section of the third side plate, the first side plate, the second end section of the second side plate, and the fifth side plate.

10. The heat exchange device according to claim 8, wherein the fourth side plate extends from a first end of the second side plate in a direction running away from the third side plate, and the fifth side plate extends from a second end of the second side plate in the direction running away from the third side plate, and wherein the water guider further comprises a second water guide groove, wherein one of the first and second water guide grooves is defined by the first end section of the second side plate, the first side plate, and the first end section of the third side plate, and the other of the first and second water guide grooves is defined by the second end section of the second side plate, the first side plate, and the second end section of the third side plate.

11. The heat exchange device according to claim 7, wherein an end of the fourth side plate away from the second side plate is in contact with the one of the first straight portion and the second straight portion, and an end of the fifth side plate away from the second side plate is in contact with the other one of the first straight portion and the second straight portion.

12. The heat exchange device according to claim 11, wherein the water guider further comprises a second water guide groove, wherein one of the first and second water guide grooves is defined by the first end section of the third side plate, the first side plate, the first end section of the second side plate and the fourth side plate, and the other of the first and second water guide grooves is defined by the second end section of the third side plate, the first side plate, the second end section of the second side plate, and the fifth side plate.

13. The heat exchange device according to claim 11, wherein the fourth side plate extends from a first end of the second side plate in a direction of the third side plate, and the fifth side plate extends from a second end of the second side plate in the direction of the third side plate.

14. The heat exchange device according to claim 11, wherein the fourth side plate extends from a first end of the second side plate in a direction running away from the third side plate, and the fifth side plate extends from a second end of the second side plate in the direction running away from the third side plate.

15. A heat exchange device, comprising:

a heat exchanger comprising:

a first header and a second header arranged in a direction;

a plurality of flat tubes, each flat tube comprising a first straight section, a second straight section and a bent section, wherein an end of the first straight section of each flat tube is connected to the first header, another end of the first straight section of each flat tube is connected to an end of the bent section of each flat tube, another end of the bent section of each flat tube is connected to an end of the second straight section of each flat tube, another end of the second straight section of each flat tube is connected to the second header, a predetermined included angle is formed between a length direction of the first straight section of each flat tube and a length direction of the second straight section of each flat tube, and the first straight section of each flat tube and the second straight section of each flat tube define a gap therebetween in the direction in which the first header and the second header are arranged; and fins arranged between the first straight sections of adjacent flat tubes of the plurality of flat tubes and between the second straight sections of adjacent flat tubes of the plurality of flat tubes, respectively, wherein the heat exchanger comprises a first straight portion, a second straight portion and a bent portion, wherein the first straight portion comprises the first straight sections of the plurality of flat tubes and the fins arranged between the first straight sections of adjacent flat tubes of the plurality of flat tubes, the second straight portion comprises the second straight sections of the plurality of flat tubes and the fins arranged between the second straight sections of adjacent flat tubes of the plurality of flat tubes, the bent portion comprises the bent sections of the plurality of flat tubes, and the bent portion encloses a groove portion that opens toward a gap between the first straight portion and the second straight portion; and a water guider having a first end and a second end, the first end of the water guider being arranged between the first straight portion and the second straight portion and in contact with the first straight portion and the second straight portion respectively, the second end of the water guider extending to the groove portion, a length direction of the water guider being substantially parallel to a width direction of the heat exchanger, the water guider having a water guide groove, a length direction of the water guide groove being substantially parallel to the length direction of the water guider, the water guide groove allowing condensed water on at least a part of the heat exchanger to flow out therethrough, wherein the water guider comprises a body, a first end plate and a second end plate, wherein the water guide groove penetrates through the body along a length direction of the body, the body has a first end and a second end in the length direction thereof, the first end plate is arranged at the first end of the body, the second end plate is arranged at the second end of the body, and at least one of the first end plate and the second end plate is provided with a port communicated with the water guide groove, wherein the body comprises:

a first side plate comprising a first end and a second end in a width direction thereof, at least a part of the first side plate is in contact with one of the first straight portion and the second straight portion;

a second side plate, an end of the second side plate being connected to the first end of the first side plate, the second side plate being located in the gap between the first straight portion and the second straight portion, and another end of the second side plate being in contact with the other one of the first straight portion and the second straight portion; and a third side plate, an end of the third side plate being connected to the second end of the first side plate, another of the third side plate being a free end, the third side plate and the second side plate being arranged opposite to each other in the width direction of the first side plate, and the third side plate being located in the groove portion, wherein the water guide groove is defined by the second side plate, the first side plate and the third side plate.

16. The heat exchange device according to claim 15, wherein an end face of the other end of the second side plate is in contact with the other one of the first straight portion and the second straight portion.

17. The heat exchange device according to claim 15, wherein a thickness of the second side plate is greater than a thickness of the third side plate.

* * * * *